US008256928B2

(12) United States Patent
Kondo

(10) Patent No.: US 8,256,928 B2
(45) Date of Patent: Sep. 4, 2012

(54) LIGHT-EMITTING DIODE LAMP WITH RADIATION MECHANISM

(75) Inventor: Masakazu Kondo, Kawasaki (JP)

(73) Assignee: Kondo Kogei Co., Ltd., Kanagawa (JP)

( * ) Notice: Subject to any disclaimer, the term of this patent is extended or adjusted under 35 U.S.C. 154(b) by 398 days.

(21) Appl. No.: 12/692,871

(22) Filed: Jan. 25, 2010

(65) Prior Publication Data

US 2010/0195331 A1 Aug. 5, 2010

(30) Foreign Application Priority Data

Jan. 30, 2009 (JP) ..... 2009-021011
Jul. 2, 2009 (JP) ..... 2009-157716

(51) Int. Cl.
*F21V 29/00* (2006.01)

(52) U.S. Cl. ..... 362/294; 362/249.025; 362/545; 362/800

(58) Field of Classification Search ..... 362/800, 362/294, 382, 391, 249.01–249.02, 249.11, 362/545, 257, 26.01, 297, 299, 308
See application file for complete search history.

(56) References Cited

U.S. PATENT DOCUMENTS

| | | | | |
|---|---|---|---|---|
| 4,729,076 | A * | 3/1988 | Masami et al. | 362/235 |
| 5,278,432 | A * | 1/1994 | Ignatius et al. | 257/88 |
| 5,785,418 | A * | 7/1998 | Hochstein | 362/373 |
| 6,472,823 | B2 * | 10/2002 | Yen | 315/112 |
| 7,874,710 | B2 * | 1/2011 | Tsai et al. | 362/373 |
| 7,934,851 | B1 * | 5/2011 | Boissevain et al. | 362/241 |
| 7,992,624 | B2 * | 8/2011 | Huang | 165/80.3 |
| 8,029,162 | B2 * | 10/2011 | Curran et al. | 362/294 |
| 8,057,071 | B2 * | 11/2011 | He et al. | 362/294 |
| 8,066,410 | B2 * | 11/2011 | Booth et al. | 362/294 |
| 8,070,306 | B2 * | 12/2011 | Ruud et al. | 362/101 |
| 8,070,324 | B2 * | 12/2011 | Kornitz et al. | 362/294 |
| 8,092,045 | B2 * | 1/2012 | Xiao et al. | 362/249.02 |
| 8,104,919 | B2 * | 1/2012 | Wung et al. | 362/217.12 |
| 8,123,378 | B1 * | 2/2012 | Ruberg et al. | 362/249.02 |
| 8,157,421 | B2 * | 4/2012 | Lee | 362/294 |
| 2001/0030866 | A1 * | 10/2001 | Hochstein | 362/294 |
| 2006/0067077 | A1 * | 3/2006 | Kumthampinij et al. | 362/294 |
| 2006/0262545 | A1 * | 11/2006 | Piepgras et al. | 362/373 |
| 2009/0303719 | A1 * | 12/2009 | Ko | 362/249.02 |
| 2010/0126697 | A1 * | 5/2010 | Huang | 165/80.3 |

FOREIGN PATENT DOCUMENTS

| | | | |
|---|---|---|---|
| CN | 102003690 | A * | 4/2011 |
| JP | 2007-500933 | | 1/2007 |
| JP | 2007-35788 | | 2/2007 |
| JP | 2007-149696 | | 6/2007 |
| JP | 2008-108721 | | 5/2008 |
| WO | 2004/111530 | | 12/2004 |

* cited by examiner

*Primary Examiner* — Anne Hines
*Assistant Examiner* — Jose M Diaz
(74) *Attorney, Agent, or Firm* — Wenderoth, Lind & Ponack, L.L.P.

(57) ABSTRACT

A LED lamp includes at least one LED element having electrode terminals, a conductive heat-receiving member electrically and mechanically connected with the electrode terminals of the at least one LED element, for receiving heat emitted from the at least one LED element via the electrode terminals, a casing for housing, at substantially sealed state, the at least one LED element and the heat-receiving member, a plurality of fins thermally coupled with the casing and arranged at a position out of a main irradiation direction of light from the at least one LED element, and a conductive heat-transfer member electrically and mechanically connected with the heat-receiving member, the heat-transfer member extending to a position at which the plurality of fins exist.

13 Claims, 9 Drawing Sheets

LIGHT-EMITTING DIODE LAMP WITH RADIATION MECHANISM

PRIORITY CLAIM

This application claims priority from Japanese patent application Nos. 2009-021011 and 2009-157716, filed on Jan. 30, 2009 and Jul. 2, 2009, which are incorporated herein by reference.

BACKGROUND OF THE INVENTION

1. Field of the Invention

The present invention relates to a light-emitting diode (LED) lamp using a LED element, particularly to a LED lamp provided with a radiation mechanism for the LED element.

2. Description of the Related Art

Recently, because of a high light-emitting efficiency and a long lifetime, LED elements are broadly utilized in various devices such as indicator devices and illumination devices. Particularly, application for a LED lamp with the LED element housed in a casing made of an insulation material such as a resin material, which can be utilized in various environments, is considered of value.

The LED element can provide a large amount of light just at power-on. However, because the LED element has a large heating value, if there is no heat radiation mechanism, the temperature of the LED element will greatly increase. For example, in case of a LED lighting installation of 0.5 W, a surface temperature of the LED element may be sometimes increased over 120° C. If the temperature of the LED element thus increases, a light-emitting efficiency of the LED element itself decreases to shorten its life in the long run. Therefore, it is absolutely necessary to take countermeasures against heat generation when the LED lighting installation uses a high output LED element to obtain a large amount of light.

A heat sink is conventionally used to suppress rise in temperature of the LED element. For example, Japanese patent publication No. 2007-035788A discloses a LED lamp unit with a heat sink arranged to keep in contact with a circuit board on which a LED element is mounted so as to radiate generated heat from the element through the heat sink.

However, if the heat sink is arranged to keep in contact with the circuit board as the LED lamp unit disclosed in Japanese patent publication No. 2007-035788A, a size of the LED lamp unit becomes big and a manufacturing cost thereof becomes higher. Also, when such LED lamp unit is attached to a ceiling as is the case with a conventional incandescent lamp, because it is necessary to keep a space for ventilation to cool the heat sink and to install an air conditioning system in the ceiling, the construction cost will become mammoth.

SUMMARY OF THE INVENTION

It is therefore an object of the present invention to provide a LED lamp capable of effectively radiating heat without using any heat sink.

According to the present invention, a LED lamp includes at least one LED element having electrode terminals, a conductive heat-receiving member electrically and mechanically connected with the electrode terminals of the at least one LED element, for receiving heat emitted from the at least one LED element via the electrode terminals, a casing for housing, at substantially sealed state, the at least one LED element and the heat-receiving member, a plurality of fins thermally coupled with the casing and arranged at a position out of a main irradiation direction of light from the at least one LED element, and a conductive heat-transfer member electrically and mechanically connected with the heat-receiving member, the heat-transfer member extending to a position at which the plurality of fins exist.

The inventor of this application has worked on the development of a small and semi-sealed type LED lamp capable of obtaining dust-tight and waterproof functions and small-footprint effect, using no heat sink. However, such LED lamp is difficult to put to practical use because the temperature of a part of a casing, around a LED element housed, becomes extremely high when the LED lamp is turned on for a long time. This is because the LED element produces a large amount of heat, high temperature air occurred by heat-conduction of the produced heat concentrates at a part of space in the casing, and then the heat of the high temperature air is conducted to the casing. If the casing is made of a good heat conduction material such as a metal material, such partial heat would be quickly conducted to the whole of the casing. However, since in most cases, the casing is made of a resin material such as polycarbonate or acrylic material that are adequate to the semi-sealed type LED lamp, with poor heat conductivity, the heat was accumulated in the resin material of the casing around the LED element.

According to the present invention, since the LED lamp is configured as mentioned above, the heat-receiving member, the heat-transfer member, the plurality of fins and the casing function to transfer the heat produced from the LED element to outside. Most of light from the LED element is irradiated to outside through the top end side of the casing, which is the side in a main light emitting direction of the LED lamp. The heat-receiving member receives the heat produced from the LED element by heat-conduction to lower the temperature of the LED element. The heat-transfer member electrically and mechanically connected with the heat-receiving member and extended to the position of the plurality of fins receives heat from the heat-receiving member by heat conduction, and radiates the received heat to the space in the casing. The heat-transfer member and the fins cooperate to actively and aggressively conduct the heat to the overall region of the casing. By performing such aggressive heat-conduction, it is possible to lower the temperature of the LED element and to exist no air of high temperature caused by heat conduction from the LED element in the casing. Thus, the casing never becomes so hot as it is impossible to touch by hand and therefore safety of the LED lamp can be expected. Also, because heat radiation from the whole of the casing is performed, the temperature of overall the casing can be lowered. Therefore, even when the LED lamp is the semi-sealed type using a casing made of a resin material having a poor thermal conductivity, the heat from the LED element will not be accumulated and the temperature of the air in the casing can be lowered to a value near the room temperature. As a result, a luminous efficiency of the LED element can be increased, and a shortening of life of the LED element due to the high heat can be prevented, that is, the life of the LED element can be kept long. Also, since no heat sink is necessary to equip at the rear side of the lighting installation, the appearance of the lighting installation becomes simple and downsizing of the lighting installation is possible.

It is preferred that one end of the heat-receiving member is connected to an electrode terminal of the at least one LED element, and the other end of the heat-receiving member abuts to an inner wall of the casing. Thus, the LED element and the heat-transfer member are firmly supported by the heat-receiving member in the casing. As a result, even if the LED lamp is installed downward or sideway, the heat-receiving member and the heat-transfer member having heavy weight are steadily supported, the LED element can be held with stability and the main irradiation direction does not change. Further, because direct heat conduction from the heat-receiving member to the casing is performed, heat from the LED element can be radiated more effectively.

It is also preferred that the heat-receiving member and the heat-transfer member are formed by fixing separately fabricated members to each other, or formed from members made in one piece. In the latter case, since the number of components is reduced, it is possible to simplify the manufacturing process and to lower the manufacturing cost.

It is further preferred that the plurality of fins are formed on an inner wall of a heat-collection fin member with an outer wall kept in contact with an inner wall of the casing. In this case, preferably, the heat-collection fin member includes a plurality of segments separately formed with each other to have a shape obtained by dividing the casing by a plane passing through the center axis of the casing.

It is still further preferred that the heat-collection fin member is made of a translucent resin material, or made of a resin material containing high thermal conductance carbon fiber fillers.

It is further preferred that the plurality of fins include heat-collection fins integrally formed with an inner wall of the casing, or heat-radiation fins integrally formed with an outer wall of the casing.

It is preferred that the casing includes a top end portion formed in a main irradiation direction of the at least one LED element, and a tubular portion is continuously formed with the top end portion at a position out of the main irradiation direction. In this case, preferably, the top end portion and the tubular portion of the casing are made of a translucent resin material, or the top end portion of the casing is made of a translucent resin material, and the tubular portion of the casing is made of a resin material containing high thermal conductance carbon fiber fillers.

It is further preferred that the heat-transfer member includes a plurality of bars or strips extending from the heat-receiving member.

It is still further preferred that the heat-transfer member constitutes a part of a feeding line for supplying power there through to the at least one LED element.

Further objects and advantages of the present invention will be apparent from the following description of the preferred embodiments of the invention as illustrated in the accompanying drawings.

DESCRIPTION OF THE PREFERRED EMBODIMENTS

Hereinafter, various embodiments of LED lamps according to the present invention with reference to the attached drawings.

Figure 1:
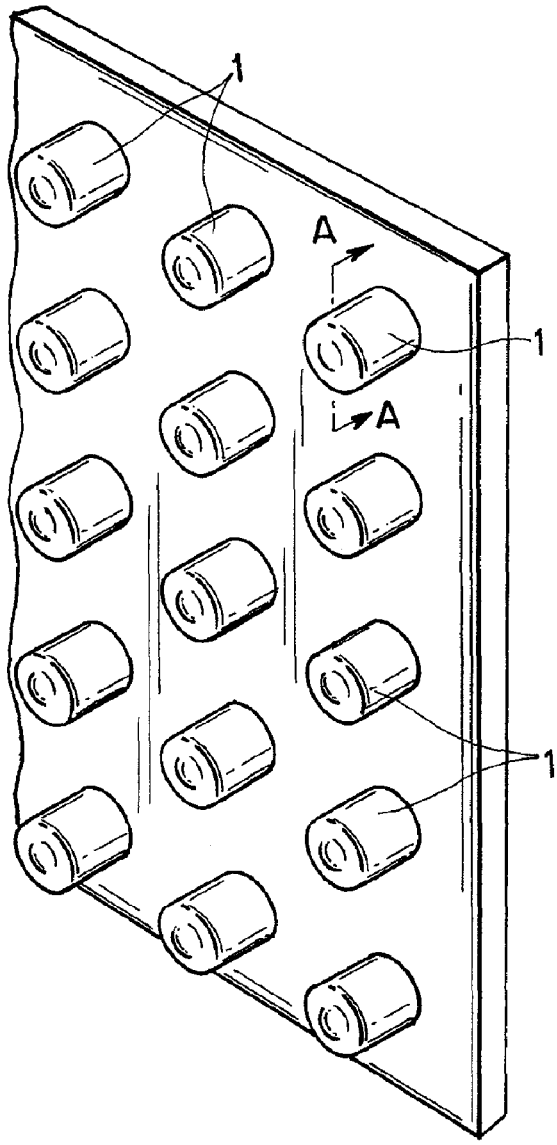
FIG. 1 is a perspective view schematically illustrating a lighting installation with a plurality of arranged LED lamps according to the present invention.

FIG. 1 schematically illustrates a lighting installation with a plurality of arranged LED lamps according to the present invention.

A LED lamp according to the present invention is a semi-sealed type lamp unit with at least one LED element mounted therein. The number of and arrangement of the lamp units to be installed will be adjusted in accordance with various applications, environments and installed locations. For example, lighting fixtures for emitting various light amounts as various applications can be provided by arranging in matrix many LED lamps 1 on a plane as shown in FIG. 1. Also, the LED lamps may be used for applications instead of the conventional incandescent lamps.

First Embodiment

Figure 2A:
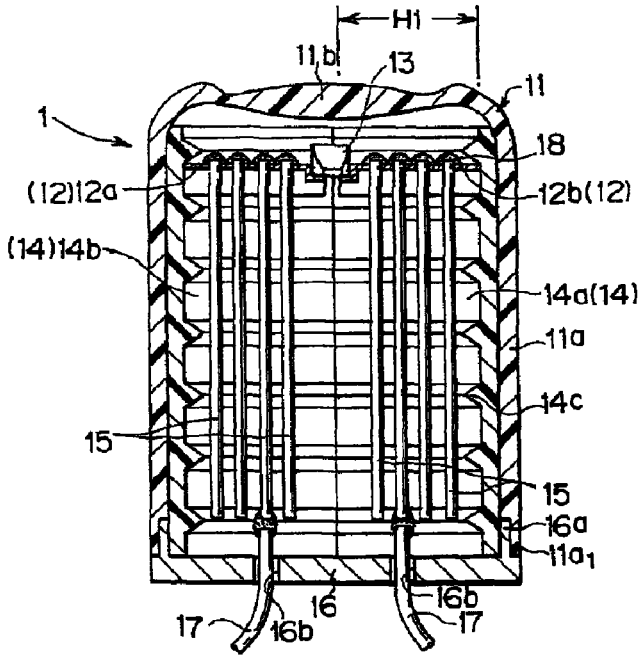
FIGS. 2A and 2B are an A-A line longitudinal section view of FIG. 1 and an exploded perspective view schematically illustrating a structure and a part of the structure of a LED lamp in a first embodiment according to the present invention.
Figure 2B:
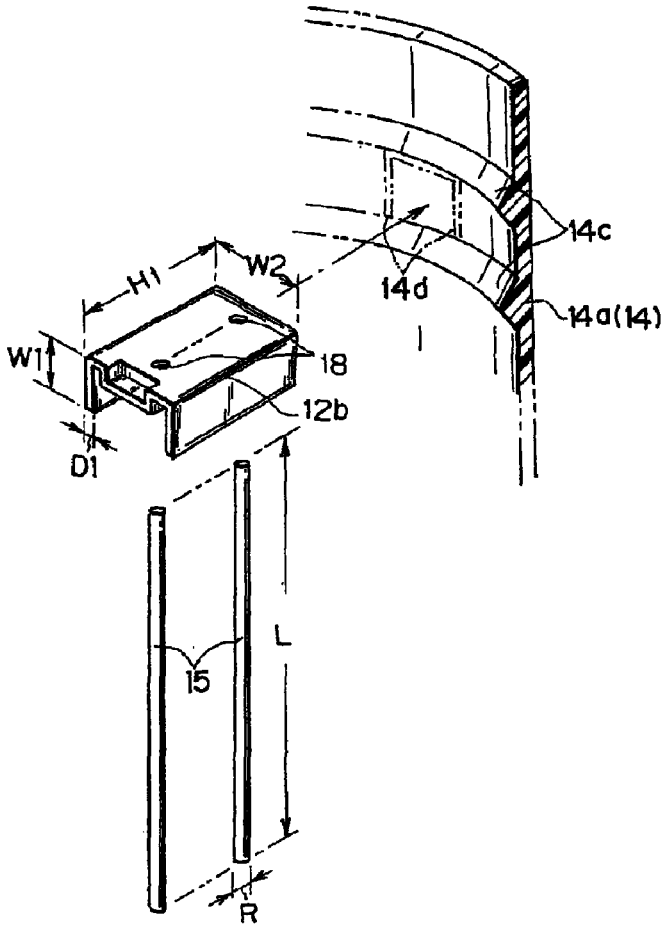
Figure 3A:
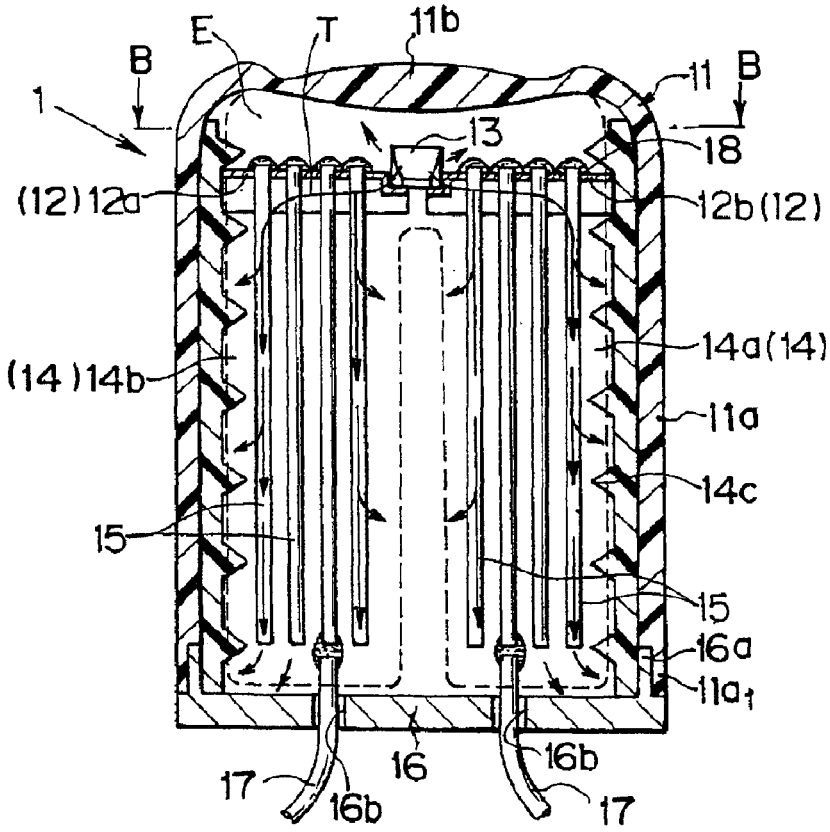
FIGS. 3A and 3B are an A-A line longitudinal section view of FIG. 1 and a B-B line cross-section view of FIG. 3A illustrating function of the LED lamp in the first embodiment.
Figure 3B:
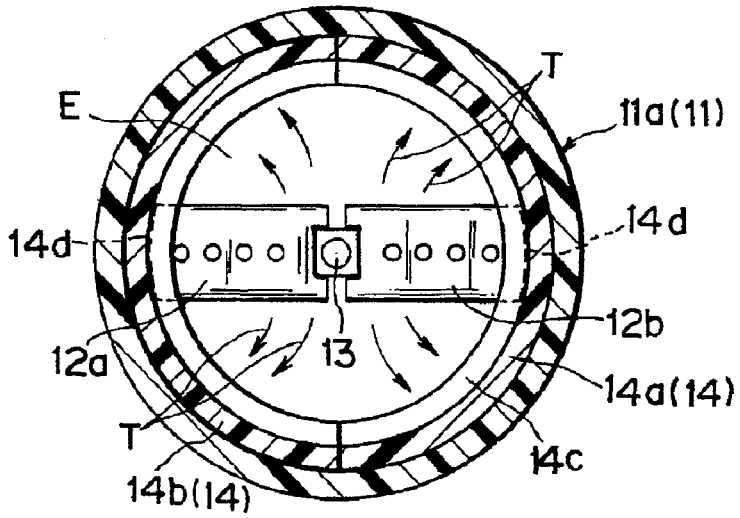

FIGS. 2A and 2B show an A-A line longitudinal section view of FIG. 1 and an exploded perspective view schematically illustrating a structure and a part of the structure of a LED lamp in a first embodiment according to the present invention, respectively, and FIGS. 3A and 3B show an A-A line longitudinal section view of FIG. 1 and a B-B line cross-section view of FIG. 3A illustrating function of the LED lamp in the first embodiment, respectively.

As shown in these figures, the LED lamp 1 has at least a casing 11, a LED element 13, a heat-receiving member 12 constituted of first and second heat-receiving parts 12*a* and 12*b* electrically and mechanically connected with electrode terminals of the LED element 13, respectively, a heat-collection fin member 14, and a heat-transfer member 15. These heat-receiving member 12, heat-collection fin member 14, heat-transfer member 15 and casing 11 constitute a heat radiation mechanism. The first heat-receiving part 12*a* and the second heat-receiving part 12*b* are arranged in a space near the top end side in the casing 11, and the heat-collection fin member 14 and the heat-transfer member 15 are arranged in a space near the base end side in the casing 11.

In this first embodiment, the whole of the casing 11 is made of a translucent resin material or a translucent glass material. A substrate 16 is fixed or adhered with the casing 11 by inserting this substrate 16 into the base end portion of the casing 11 so that the LED element 13, the heat-receiving member 12, the heat-collection fin member 14 and the heat-transfer member 15 are housed in the casing 11 under a semi-sealed state. Thus, the LED element 13, the heat-receiving member 12, the heat-collection fin member 14 and the heat-transfer member 15 are protected inside, and heat produced from the LED element 13 is radiated through the casing 11 to the outside. This casing 11 formed by molding, for example, a translucent resin material such as polycarbonate or acrylic material, or a translucent glass material, and the substrate 16 formed from the same material as the casing 11 are assembled to constitute a semi-sealed container.

The casing 11 in this first embodiment is molded in one piece with a tubular portion lie and a top end portion 11*b*. However, in a modification, a tubular portion 11*a* and a top end portion 11*b* may be separately formed as discrete components and thereafter these discrete components may be fixed or adhered with each other to be integrated. Also, in another modification, the tubular portion 11*a* may be formed in, for example, a cylinder shape, a round pipe shape such as an oval pipe shape, a corner pipe shape, or other pipe shape with an optional cross-section.

The casing 11 has a translucency capable of transmitting light from at least the LED element 13 to illuminate the outside. In the configuration shown in FIGS. 2A, 2B, 3A and 3B, light from the LED element 13 is transmitted mainly through the tope end face portion 11*b* to illuminate the outside of the top end side. A lens may be formed at the top end portion 11*b*, namely as in this first embodiment, a central part of the top end portion 11*b* is formed in a convex shape and a neighboring circular part thereof is formed in a concave circular shape. In a modification, a Fresnel lens may be formed at the top end portion 11*b*. In another modification, it is desired that the casing 11 is formed from a material of synthetic resin powder with scattered dispersing agents or anti-dazzle agents for reducing light intensity.

The substrate 16 is attached to an opening portion at the base end side of the casing 11 to close the opening of the casing 11 so as to keep the casing under the semi-sealed condition. A circular projection 16*a* having locking pawl (not shown) is formed on the top surface of the substrate 16. This circular projection 16*a* is inserted into a circular end edge $\mathbf{11}a_1$ formed on the tubular portion 11*a* of the casing 11 so that the substrate 16 and the casing 11 are adhered or fixed with each other. Also, through the substrate 16, formed are through-holes 16*b* to pass lines of a power supply cord 17. Furthermore, screw holes may be formed through the substrate 16 so that the LED lamp 1 can be fixed to a mounting fixture by screws. The LED lamp 1 may be fixed to the mounting fixture by a pair of electrode terminals projecting from the substrate 16.

In this first embodiment, the casing 11 and the substrate 16 are separately formed as discrete components. However, in a modification, the tubular portion 11*a* and the top end portion 11*b* of the casing 11 are separately formed to use the top end portion 11*b* as a cap. In the latter case, the tubular portion 11*a* of the casing 11 and the substrate 16 may be formed by molding in one piece of the resin material to decrease the number of components and the number of assembling processes so as to decrease the manufacturing cost.

Each of the first heat-receiving part 12*a* and the second heat-receiving part 12*b* that constitute the heat-receiving member 12 is formed by pressing a metal plate-like member with good conductivity and good heat transmission such as for example a copper plate, an aluminum plate, a nickel-plated copper plate or a nickel-plated aluminum plate to have a channel shape with a U-shaped section. Thanks for the channel shape, although the private space is small, the heat-receiving part can have a large surface area for providing good heat radiation effect. The first heat-receiving part 12*a* and the second heat-receiving part 12*b* are arranged in the casing 11 so that the bottom surface of the channel shape is located at the upper side, namely the both side ends of each heat-receiving part downwardly bend. One ends of the first heat-receiving part 12*a* and the second heat-receiving part 12*b* are connected with a pair of electrode terminals of the chip-type LED element 13, respectively, by means of welding or brazing such as soldering. In other words, the LED element 13 is sandwiched between the first heat-receiving part 12*a* and the second heat-receiving part 12*b* and thus supported from both sides. The other ends of the first heat-receiving part 12*a* and the second heat-receiving part 12*b* abut with an inner wall of the heat-collection fin member 14 at a contact surface 14*d*. That is, the first heat-receiving part 12*a* and the second heat-receiving part 12*b* of the heat-receiving member 12 radially extend from the connected portion with the LED element 13 in a cross section or a slice plane in the casing 11, and touch the inner wall of the heat-collection heat fin member 14. Thus, a length H1 of each of the first heat-receiving part 12*a* and the second heat-receiving part 12*b* is determined so that sum of the length of the LED element 13 and the double of this length H1 is substantially equal to an inside diameter of the heat-collection fin member 14.

Therefore, the first heat-receiving part 12*a* and the second heat-receiving part 12*b* serve as, other than the feeding lines, heat-transmission members for receiving heat from the LED element 13 and for transferring the received heat to the heat-collection fin member 14 and also to the heat-transfer member 15 so as to suppress increase in temperature of the LED element 13 and thus to maintain life of the LED element 13.

An area of each contact surface 14*d* on the heat-collection fin member 14, that is, a area of the contact region between each of the other ends of the first heat-receiving part 12*a* and the second heat-receiving part 12*b* and the inner wall of the heat-collection fin member 14 depends on an area of the U-shaped section of the channel shape, which is determined from a height W1, a width W2 and a thickness D1 of each of the first heat-receiving part 12*a* and the second heat-receiving part 12*b* (see FIG. 2B). If this area of the section is large, the contact surface 14*d* becomes large and thus high heat conduction effect from the heat-receiving member 12 to the heat-collection fin member 14 can be obtained.

The bottom surfaces of the channel shaped first heat-receiving part 12*a* and the channel shaped second heat-receiving part 12*b* have a plurality of holes 18 for inserting as will be described later one ends of the heat-transfer member 15 there through.

One or more LED elements 13 are arranged in the casing 11. In this first embodiment, a single chip-type LED element 13 is mounted at substantially the axis center in the casing 11 to emit light there from toward the top end direction of the casing 11. As mentioned before, one electrode terminal of the LED element 13 is connected and supported by one end of the first heat-receiving part 12*a*, and the other electrode terminal of the LED element 13 is connected and supported by one end of the second heat-receiving part 12*b*. Although a chip-type element is adopted for the LED element 13 in this first embodiment, a cannon ball type or a segment type element can be adopted for the LED element 13 in modifications.

A direct current is supplied to the LED element 13 through the first heat-receiving part 12*a* and the second heat-receiving part 12*b* electrically connected to the electrode terminals of this LED element 13. The LED element 13 thus emits light and this emitted light is radiated outwardly mainly through the top end portion 11*b* of the casing 11. Because the heat produced from the LED element 13 is conducted through the electrode terminals to the first heat-receiving part 12*a* and the second heat-receiving part 12*b*, and outwardly radiated as will be described later, the LED element 13 is suppressed to maintain its temperature and therefore the luminous efficiency of the LED element 13 is kept at a high level. It should be noted that the light from the LED element 13 is irradiated outside mainly through the top end face side, and that heat from the LED element 13 is radiated not from this top end face side but from the radial direction side of the heat-collection fin member 14 and the base end side of the casing 11.

The heat-collection fin member 14 is formed of a cylinder with an outer wall that firmly attached to an inner wall of the casing 11 so that heat transmission from the fin member 14 to the casing 11 is possible, in other words, so that the fin member 14 is thermally coupled to the casing 11. Particularly, in this first embodiment, the fin member 14 is formed by assembling and fixing a first segment 14*a* and a second segment 14*b* each having a half cylinder shape, which would be obtained by dividing a cylinder shape into two segments by a plane passing through the center axis of the cylinder. In modifications, the segment may have a shape obtained by dividing a cylinder shape into three or more by a plane passing through the center axis of the cylinder. The heat-collection fin member 14 is made of, for example, a translucent resin material such as polycarbonate or acrylic material, that is, the same material as the casing 11. A plurality of fins 14*c* having heat-collecting function are integrally formed with the inner wall of the heat-collection fin member 14. Because the fin member 14 is preliminarily divided in the first segment 14*a* and the second segment 14*b*, it is easy to mold these first and second segments 14*a* and 14*b* and the plurality of fins 14*c*.

The fin member 14 is formed so that its length along the axis direction is shorter than an axis direction length of the tubular portion 11*a* of the casing 11. Thus, the heat-collection fin member 14 is firmly attached to the inner wall of the casing 11 at the position of the tubular portion 11*a*, which is out of the main irradiating direction from the LED element 13, namely not the top end portion 11*b* of the casing 11. Therefore, the inner wall of the fin member 14 faces a big capacity space located under the first heat-receiving part 12*a* and the second heat-receiving part 12*b*.

The plurality of fins 14*c* formed on the inner wall of the heat-collection fin member 14 are arranged with an interval in a longitudinal direction of the fin member 14, and each fin 14*c* has a rib shape extending along the circumferential direction of the fin member 14. In modifications of this first embodiment, each fin 14*c* may be a fin with a column shape (rib shape extending the longitudinal direction), a spiral shape, a mesh shape, a porous plate shape or other not flat shape. The plurality of fins 14*c* are formed at an interval, which is determined so that air can freely flow to easily occur convection of air. Thus, adequate heat transfer from air to the fins 14*c* can be performed. In modifications, the heat-collection fin member 14 may be molded in one piece with the casing 11.

The heat-transfer member 15 is configured from a plurality of hollow or solid bars made of a metal material with good heat-transfer characteristics, such as copper, aluminum or else. One ends of these bars are engaged in holes 18 formed through the first heat-receiving part 12*a* and the second heat-receiving part 12*b*, and then electrically and mechanically connected or fixed with the first heat-receiving part 12*a* and the second heat-receiving part 12*b* by soldering. The bars are linearly extended downward and the other ends thereof are located, as free ends, at a height corresponding to the lower end of the heat-collection fin member 14. It is desired from a point of view of heat-transmission that the heat-transfer member 15 is in contact with the heat-collection fin member 14. However, in practice, it is enough as shown in FIGS. 2A and 3A that the heat-transfer member 15 is extended along the fin member 14 apart from the LED element 13.

Desirably, the heat-transfer member 15 and the heat-receiving member 12 are made of the same material. It is important that the bars connected with the first heat-receiving part 12*a* and the bars connected with the second heat-receiving part 12*b* are never electrically in contact with each other to avoid occurrence of short-circuit.

In this first embodiment, each bar of the heat-transfer member 15 is configured from a copper pipe linearly extending, and has a surface area that depends upon a length L and an outer diameter R of the copper pipe (see FIG. 2B). If the length L and/or the outer diameter R increase, due to the hollow pipe, the total surface area further increases causing the heat conduction effect to more increase. By the way, in this first embodiment, a copper pipe of R=2 mm ϕ is used. In modifications, a solid line of a copper wire of R=1 mm ϕ may be used as for the bar. However, in the latter case, the surface area will become small.

The power supply cord 17 is electrically connected to one bar of the heat-transfer member 15, which is connected with the first heat-receiving part 12*a* and to one bar of the heat-transfer member 15, which is connected with the second heat-receiving part 12*b*, respectively. Drive current will be fed through the power supply cord 17 from the outside. This current is supplied to the LED element 13 through the power supply cord 17, the heat-transfer member 15 and the first heat-receiving part 12*a* or the second heat-receiving part 12*b*.

In a modification of this first embodiment, each bar of the heat-transfer member 15 is formed from a solid line, an elongated solid bar, an elongated plate member, an elongated mesh member, an elongated porous member or others. This heat-transfer member 15, the first heat-receiving part 12*a* and the second heat-receiving part 12*b* may be formed by molding in one piece.

When assembling such LED lamp 1, first, the power supply cord 17 is connected to an assembly of the LED element 13, the heat-receiving member 12 and the heat-transfer member 15, and then the assembly is mounted on the substrate 16. Thereafter, the assembly with the substrate 16 is sandwiched between the first segment 14*a* and the second segment 14*b* of the heat-collection fin member 14, and then the casing 11 is attached to cover the heat-collection fin member 14 so as to integrate the heat-collection fin member 14 and the casing 11. As a result, the LED lamp 1 can be easily assembled.

According to thus assembled LED lamp 1, by feeding power to the LED element 13 via the power supply cord 17, the heat-transfer member 15 and the first heat-receiving part 12*a* and the second heat-receiving part 12*b*, the LED element 13 emits light, which is mainly irradiated to top end outward direction through the top end portion 11*b* of the casing 11. A part of light is irradiated circumference through the heat-collection fin member 14 and the tubular portion 11*a* of the casing 11.

On the other hand, as shown in FIG. 3A, heat T produced from the LED element 13 is conducted to the first heat-receiving part 12*a* and the second heat-receiving part 12*b* of the heat-receiving member 12, conducted from the heat-receiving member 12 to the heat-transfer member 15, radiated to the space from the heat-transfer member 15, and thereafter collected by the heat-collection fin member 14. The collected heat is conducted from the fin member 14 to the inner wall of the casing 11, and then radiated outside from the outer wall of the casing 11. Also, the heat T produced from the LED element 13 is conducted to the first heat-receiving part 12*a* and the second heat-receiving part 12*b* of the heat-receiving member 12, directly radiated to the surrounding space from the heat-receiving member 12, and collected by the heat-collection fin member 14. The collected heat is conducted from the fin member 14 to the casing 11, and then radiated outside from the casing 11. Furthermore, according to the structure of this first embodiment, since the first heat-receiving part 12*a* and the second heat-receiving part 12*b* are in contact with the inner wall of the heat-collection fin member 14, direct heat conduction in high efficiency from the heat-receiving member 12 to the fin member 14 is performed. The conducted heat is transferred to the casing 11 and then radiated to the outside.

As will be noted, the heat-receiving member 12 has functions of receiving heat from the LED element 13 by heat conduction, and of lowering the temperature of the LED element 13. The heat-transfer member 15 thermally coupled with the heat-receiving member 12 and extended downward has functions of receiving heat from the heat-receiving member 12 by heat conduction, and of transferring the received heat to the space close to the heat-collection fin member 14 so as to radiate the heat. The heat-collection fin member 14 has functions of collecting the heat of the air in the space, and of conducting the collected heat to the casing 11 to radiate the heat outside. In this case, the heat from the LED element 13 is almost collected by the heat-collection fin member 14 to concentrate the heat to a part of the casing 11, that is out of the top end portion 11*b* through which the light is mainly irradiated, so as to increase a heat radiation amount through this part of the casing 11 to outside. Thus, even if the LED lamp 1 is turned on for a long time, a temperature of the whole outside surface of the casing 11 can be lowered to a degree that is not so hot when handling. As a result, a luminous efficiency of the LED element 13 can be increased, and a shortening of life of the LED element 13 due to the high heat can be prevented.

In the conventional LED lamp with no heat-receiving member, no heat-transfer member and no heat-collection fin member, a temperature of a top end portion of the casing, through which the light is mainly irradiated, becomes extremely high and thus it is impossible to handle this portion of the casing. However, in this first embodiment, the heat-collection fin member 14 is arranged out of the top end portion 11*b* that is located in a main light emitting direction of the LED lamp 1. Further, due to heat conduction of the heat-receiving member 12 and the heat-transfer member 15, the heat from the LED element 13 is collected to the heat-collection fin member 14, and also the heat in the space in the casing 11 is concentrated to the heat-collection fin member 14. Therefore, the heat in the casing 11 is transferred with a high efficiency to a wide area of the casing 11, that is out of the top end portion 11*b* in a main light emitting direction of the LED lamp 1 so as to reduce an amount of heat conducted to the top end portion 11*b*. As a result, the top end portion 11*b* of the casing 11 does not become so hot as it is impossible to touch by hand, and the heat inside is radiated from the whole surface of the casing 11 to require no heat sink.

As described above, according to the first embodiment, although the LED lamp 1 is provided with the casing 11, made of a resin material having a poor thermal conductivity, for housing, in a semi-sealed state, the LED element 13 that is in other words a heater element with a high output, the heat from the LED element 13 is actively and aggressively conducted to the overall region of the casing 11 by cooperation of the first heat-receiving part 12*a* and the second heat-receiving part 12*b* of the heat-receiving member 12, the heat-transfer member 15 and the heat-collection fin member 14, radiated to air in a wide space E in the casing 11, and heat-exchanged between the whole outer surface of the casing 11 and outside air so as to perform heat radiation from the whole casing 11 for lowering the temperature of the casing 11. By performing such aggressive heat-conduction, it is possible to lower the temperature of the LED element 13 and to exist no air of high temperature caused by heat conduction from the LED element 13 in the casing 11. Thus, the casing 11 never becomes so hot as it is impossible to touch by hand and therefore safety of the LED lamp 1 can be expected. Also, because heat radiation from the whole of the casing 11 is performed, the temperature of overall the casing 11 can be lowered. Therefore, even when the LED lamp 1 is the semi-sealed type, the heat from the LED element 13 will not be accumulated and the temperature of the air in the casing 11 can be lowered to a value near the room temperature. As a result, it is possible to use a high output LED element, and also since no heat sink is necessary to equip, the appearance of the lighting installation becomes simple and downsizing of the lighting installation is possible.

Further, according to the first embodiment, since the LED element 13 is supported near the top end side of the casing 11, which is the side in a main light emitting direction of the LED lamp 1, a large amount of light in the main irradiation direction can be obtained. Also, because the heat-transfer member 15 is not located in this direction, this member 15 will not block irradiation of light from the LED element 13. Since the LED element 13 and the heat-transfer member 15 are firmly supported by the heat-receiving member 12 in the casing 11, the LED element 13 can be held with stability and the main irradiation direction does not change, irrespective of the arrangement of the LED lamp 1. Still further, because direct heat conduction from the heat-receiving member 12 to the heat-collection fin member 14 and the casing 11 is performed through the contact surface 14*d*, heat from the LED element 13 can be radiated more effectively.

According to the first embodiment, furthermore, because the first segment 14*a* and the second segment 14*b* and the plurality of fins 14*c* are integrated, good heat-conduction and heat-collection effect can be expected. Also, the heat-collection fin member 14 can be freely designed in a shape whereby easy heat-transfer in the direction to the casing 11 can be expected. In addition, since the heat-collection fin member 14 can be easily molded and assembling of the LED lamp 1 is easy, it is possible to fabricate the LED lamp 1 in low-cost.

Second Embodiment

Figure 4A:
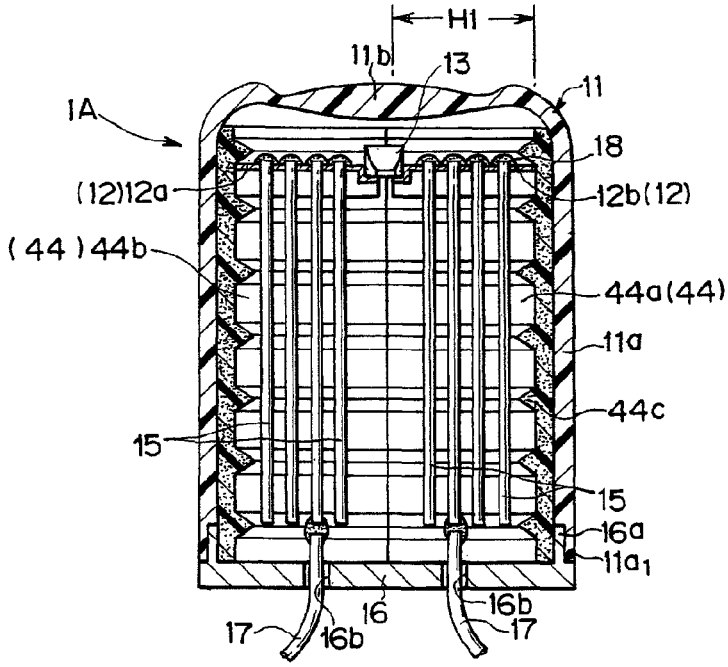
FIGS. 4A and 4B are an A-A line longitudinal section view of FIG. 1 and an exploded perspective view schematically illustrating a structure and a part of the structure of a LED lamp in a second embodiment according to the present invention.
Figure 4B:
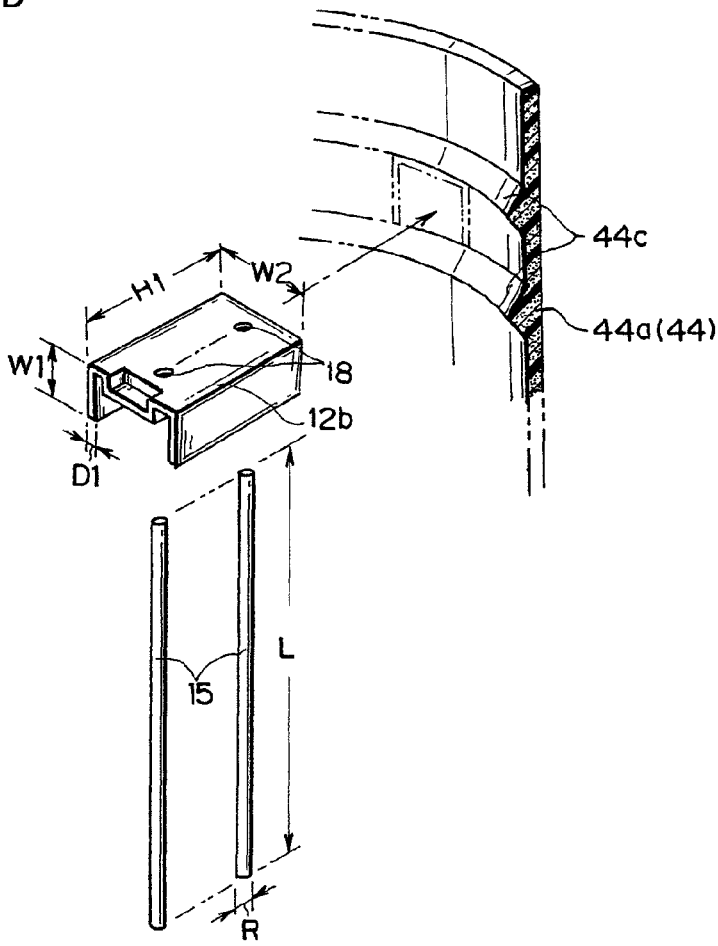

FIGS. 4A and 4B show an A-A line longitudinal section view of FIG. 1 and an exploded perspective view schematically illustrating a structure and a part of the structure of a LED lamp in a second embodiment according to the present invention, respectively. In FIGS. 4A and 4B, the same components as these in FIGS. 2A and 2B are indicated by using the same reference numerals.

In this second embodiment, a heat-collection fin member 44 of a LED lamp 1A is formed by molding a mixture material of resin and black high thermal conductance carbon fiber fillers such as, for example, Raheama (registered trademark) of Teijin Ltd. but not general translucent resin material such as polycarbonate or acrylic as the heat-collection fin member 14 in the first embodiment. The heat-collection fin member 44 is formed by assembling and fixing a first segment 44*a* and a second segment 44*b* each having a half cylinder shape, which would be obtained by dividing a cylinder shape into two segments by a plane passing through the center axis of the cylinder. A plurality of fins 44*c* having heat-collecting function are integrally formed with the inner wall of the heat-collection fin member 44.

Configuration of the LED lamp 1A of this second embodiment is quite the same as that of the LED lamp 1 of the first embodiment except as the material of the heat-collection fin member 44. Because the heat-collection fin member 44 is made of the resin material containing the high thermal conductance carbon fiber fillers, heat collection and heat-conduction effect of this fin member 44 is remarkably improved to further reduce the temperature of whole of the LED lamp 1A.

Other functions, advantages and modifications in this second embodiment are similar to these in the first embodiment.

Third Embodiment

Figure 5A:
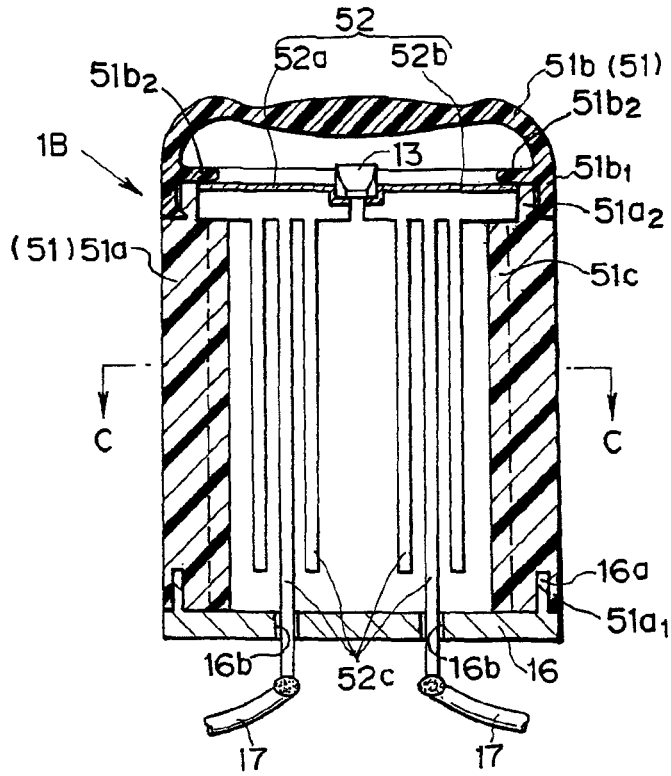
FIGS. 5A and 5B are an A-A line longitudinal section view of FIG. 1 and an exploded perspective view schematically illustrating a structure and a part of the structure of a LED lamp in a third embodiment according to the present invention.
Figure 5B:
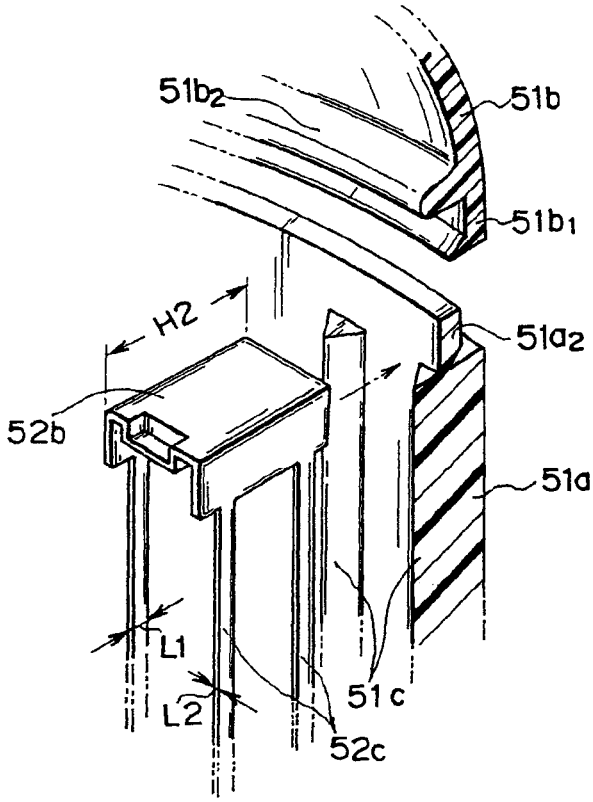
Figure 6:
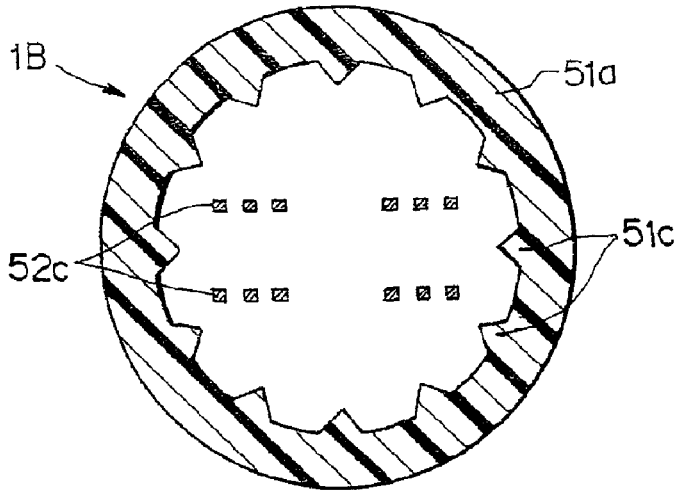
FIG. 6 is a C-C line cross-section view of FIG. 5A.

FIGS. 5A and 5B show an A-A line longitudinal section view of FIG. 1 and an exploded perspective view schematically illustrating a structure and a part of the structure of a LED lamp in a third embodiment according to the present invention, respectively, and FIG. 6 shows a C-C line cross-section view of FIG. 5A. In FIGS. 5A, 5B and 6, the same components as these in the first embodiment of FIGS. 2A, 2B, 3A and 3B are indicated by using the same reference numerals.

As shown in FIGS. 5A, 5B and 6, the LED lamp 1B has at least a casing 51, a LED element 13, a heat-receiving member 52 constituted of first and second heat-receiving parts 52*a* and 52*b* electrically and mechanically connected with electrode terminals of the LED element 13, respectively, and a heat-transfer member 52*c*. The casing 51 is formed, in this third embodiment, by assembling and fixing (adhering) a tubular portion 51*a* at a lower side and a top end portion 51*b* at upper side, which were independently fabricated, with each other. The heat-receiving member 52, the heat-transfer member 52*c* and the tubular portion 51*a* of the casing 51, which functions as a heat-collection fin member, constitute a heat radiation mechanism. The first heat-receiving part 52*a* and the second heat-receiving part 52*b* are arranged in a space near the top end side in the casing 51, and the tubular portion 51*a*, which functions as a heat-collection fin member, and the heat-transfer member 52*c* are arranged in a space near the base end side in the casing 51.

In this third embodiment, the whole of the casing 51 is made of a translucent resin material or a translucent glass material. A substrate 16 is fixed or adhered with the casing 11 by inserting this substrate 16 into the base end portion of the casing 11 so that the LED element 13, the heat-receiving member 52 and the heat-transfer member 52*c* are housed in the casing 51 under a semi-sealed state. Thus, the LED element 13, the heat-receiving member 52 and the heat-transfer member 52*c* are protected inside, and heat produced from the LED element 13 is radiated through the tubular portion 51*a* of the casing 51, which functions as a heat-collection fin member, to the outside. This casing 51 formed by molding, for example, a translucent resin material such as polycarbonate or acrylic material, or a translucent glass material, and the substrate 16 formed from the same material as the casing 51 are assembled to constitute a semi-sealed container.

The casing 51 in this third embodiment is formed by assembling and fixing (adhering) the tubular portion 51*a* and the top end portion 51*b*, which were separately fabricated, with each other. A circular projection $\mathbf{51}a_2$ is formed on the top surface of the tubular portion 51*a*. This circular projection $\mathbf{51}a_2$ is engaged with a circular end edge $\mathbf{51}b_1$ having locking pawl (not shown), of the top end portion 51*b* so that the tubular portion 51*a* and the top end portion 51*b* are adhered or fixed with each other. The top end of the circular projection $\mathbf{51}a_2$ abuts to a circular rib $\mathbf{51}b_2$ formed inside of the top end portion 51*b*. In this third embodiment, the tubular portion 51*a* and the top end portion 51*b* were separately formed as discrete components and thereafter these discrete components were fixed or adhered with each other to be integrated. However, in a modification, the tubular portion 51*a* and the top end portion 51*b* may be molded in one piece. Also, in another modification, the tubular portion 51*a* may be formed in, for example, a cylinder shape, a round pipe shape such as an oval pipe shape, a corner pipe shape, or other pipe shape with an optional cross-section.

The casing 51 has a translucency capable of transmitting light from at least the LED element 13 to illuminate the outside. In the configuration shown in FIGS. 5A, 5B and 6, light from the LED element 13 is transmitted mainly through the top end portion 51*b* to illuminate the outside of the top end side. A lens may be formed at the top end portion 51*b*, namely as in this third embodiment, a central part of the top end portion 51*b* is formed in a convex shape and a neighboring circular part thereof is formed in a concave circular shape. In a modification, a Fresnel lens may be formed at the top end portion 51*b*. In another modification, it is desired that the casing 51 is formed from a material of synthetic resin powder with scattered dispersing agents or antidazzle agents for reducing light intensity.

The substrate 16 is attached to an opening portion at the base end side of the casing 51 to close the opening of the tubular portion 51*a* of the casing 51 so as to keep the casing under the semi-sealed condition. A circular projection 16*a* having locking pawl (not shown) is formed on the top surface of the substrate 16. This circular projection 16*a* is inserted into a circular end edge $\mathbf{51}a_1$ formed on the tubular portion 51*a* of the casing 51 so that the substrate 16 and the casing 51 are adhered or fixed with each other. Also, through the substrate 16, formed are through-holes 16*b* to pass lines of a power supply cord 17. Furthermore, screw holes may be formed through the substrate 16 so that the LED lamp 1B can be fixed to a mounting fixture by screws. The LED lamp 1B may be fixed to the mounting fixture by a pair of electrode terminals projecting from the substrate 16.

In this third embodiment, the substrate 16 and the tubular portion 51*a* of the casing 51 are separately formed as discrete components. However, in a modification, the substrate 16 and the tubular portion 51*a* may be formed by molding in one piece of the resin material to decrease the number of components and the number of assembling processes so as to decrease the manufacturing cost.

Each of the first heat-receiving part 52*a* and the second heat-receiving part 52*b* that constitute the heat-receiving member 52 is formed by pressing a metal plate-like member with good conductivity and good heat transmission such as for example a copper plate, an aluminum plate, a nickel-plated copper plate or a nickel-plated aluminum plate to have a channel shape with a U-shaped section. Thanks for the channel shape, although the private space is small, the heat-receiving part can have a large surface area for providing good heat radiation effect. The first heat-receiving part 52*a* and the second heat-receiving part 52*b* are arranged in the casing 51 so that the bottom surface of the channel shape is located at the upper side, namely the both side ends of each heat-receiving part downwardly bend. One ends of the first heat-receiving part 52*a* and the second heat-receiving part 52*b* are connected with a pair of electrode terminals of the chip-type LED element 13, respectively, by means of welding or brazing such as soldering. In other words, the LED element 13 is sandwiched between the first heat-receiving part 52*a* and the second heat-receiving part 52*b* and thus supported from both sides. The other ends of the first heat-receiving part 52*a* and the second heat-receiving part 52*b* abut with and fixed to an inner surface of the circular projection $\mathbf{51}a_2$ of the tubular portion 51*a* and the bottom surface of the circular rib $\mathbf{51}b_2$ of the top end portion 51*b*. That is, the first heat-receiving part 52*a* and the second heat-receiving part 52*b* of the heat-receiving member 52 radially extend from the connected portion with the LED element 13 in a cross section or a slice plane in the casing 51, and touch the inner wall of the circular projection 51$a_2$ of the tubular portion 51*a*. Thus, a length H2 of each of the first heat-receiving part 52*a* and the second heat-receiving part 52*b* is determined so that sum of the length of the LED element 13 and the double of this length H2 is substantially equal to an inside diameter of the circular projection 51$a_2$ of the tubular portion 51*a*.

Therefore, the first heat-receiving part 52*a* and the second heat-receiving part 52*b* serve as, other than the feeding lines, heat-transmission members for receiving heat from the LED element 13 and for transferring the received heat to the casing 51 and also to the heat-transfer member 52*c* so as to suppress increase in temperature of the LED element 13 and thus to maintain life of the LED element 13.

A plurality of strips that constitute the heat-transfer member 52*c* are linearly extended downward from the top surface of the channel shape of the first heat-receiving part 52*a* and the second heat-receiving part 52*b*. These strips are formed integral with the first heat-receiving part 52*a* and the second heat-receiving part 52*b*.

One or more LED elements 13 are arranged in the casing 51. In this third embodiment, a single chip-type LED element 13 is mounted at substantially the axis center in the casing 51 to emit light there from toward the top end direction of the casing 51. As mentioned before, one electrode terminal of the LED element 13 is connected and supported by one end of the first heat-receiving part 52*a*, and the other electrode terminal of the LED element 13 is connected and supported by one end of the second heat-receiving part 52*b*. Although a chip-type element is adopted for the LED element 13 in this first embodiment, a cannon ball type or a segment type element can be adopted for the LED element 13 in modifications.

A direct current is supplied to the LED element 13 through the first heat-receiving part 52*a* and the second heat-receiving part 52*b* electrically connected to the electrode terminals of this LED element 13. The LED element 13 thus emits light and this emitted light is radiated outwardly mainly through the top end portion 51*b* of the casing 51. Because the heat produced from the LED element 13 is conducted through the electrode terminals to the first heat-receiving part 52*a* and the second heat-receiving part 52*b*, and outwardly radiated as will be described later, the LED element 13 is suppressed to maintain its temperature and therefore the luminous efficiency of the LED element 13 is kept at a high level. It should be noted that the light from the LED element 13 is irradiated outside mainly through the top end face side, and that heat from the LED element 13 is radiated not from this top end face side but from the radial direction side of the tubular portion 51*a* of the casing 51.

A plurality of fins 51*c* having heat-collecting function are integrally formed with the inner wall of the tubular portion 51*a* of the casing 51. These fins 51*c* face a large volume space existed under the first heat-receiving part 52*a* and the second heat-receiving part 52*b*.

The plurality of fins 51*c* formed on the inner wall of the tubular portion 51*a* are arranged with an interval in a circumferential direction of the tubular portion 51*a*, and each fin 51*c* has a rib shape extending along the axis direction. In modifications of this third embodiment, each fin 51*c* may be a fin with a spiral shape, a mesh shape, a porous plate shape or other not flat shape. The plurality of fins 51*c* are formed at an interval, which is determined so that air can freely flow to easily occur convection of air. Thus, adequate heat transfer from air to the fins 51*c* can be performed.

The heat-transfer member 52*c* in this third embodiment is constituted by the strips formed integral with the first heat-receiving part 52*a* and the second heat-receiving part 52*b*, and extended from the top surface of the channel shape of the first heat-receiving part 52*a* and the second heat-receiving part 52*b*. Each strip is linearly extended downward and ends thereof are located, as free ends, at a region where the fins 51*c* are existed. It is desired from a point of view of heat-transmission that the heat-transfer member 52*c* is in contact with the fins 51*c*. However, in practice, it is enough as shown in FIG. 5A that the heat-transfer member 52*c* is extended along the fins 51*c* apart from the LED element 13. It is important that the heat-transfer member 52*c* connected with the first heat-receiving part 52*a* and the heat-transfer member 52*c* connected with the second heat-receiving part 52*b* are never electrically in contact with each other to avoid occurrence of short-circuit.

In this third embodiment, each strip of the heat-transfer member 52*c* has a surface area that depends upon a length, a width L1 and a thickness L2 that is equal to a thickness of the heat-receiving member 52 (see FIG. 5B). If an interval between the neighbor strips of the heat-transfer member 52*c*, which corresponds to a length H2 of each heat-receiving part and/or the width L1 are adequately designed, the surface area increases causing the heat conduction effect to more increase. By the way, in this third embodiment, the interval between the neighbor strips of the heat-transfer members 52*c* is about 1-3 mm. Since the heat-receiving member 52 and the heat-transfer member 52*c* are formed integral, it is possible to decrease the number of components and the number of assembling processes so as to decrease the manufacturing cost.

The power supply cord 17 is electrically connected to one strip of the heat-transfer member 52*c*, which is connected with the first heat-receiving part 52*a* and to one strip of the heat-transfer member 52*c*, which is connected with the second heat-receiving part 52*b*, respectively. Drive current will be fed through the power supply cord 17 from the outside. This current is supplied to the LED element 13 through the power supply cord 17, the heat-transfer member 52*c* and the first heat-receiving part 52*a* or the second heat-receiving part 52*b*.

When assembling such LED lamp 1B, first, the LED element 13 and the heat-receiving member 52 with the heat-transfer member are assembled, and then the assembly is sandwiched between the circular projections 51$a_2$ of the tubular portion 51*a* of the casing 51. Then, the top end portion 51*b* of the casing 51 is attached to cover the tubular portion 51*a* and the substrate 16 is fixed or adhered with the tubular portion 51*a* of the casing 51. Thereafter, the power supply cord 17 is connected to the assembly. As a result, the LED lamp 1B can be easily assembled.

According to thus assembled LED lamp 1A, by feeding power to the LED element 13 via the power supply cord 17, the heat-transfer member 52*c* and the first heat-receiving part 52*a* and the second heat-receiving part 52*b*, the LED element 13 emits light, which is mainly irradiated to top end outward direction through the top end portion 51*b* of the casing 51. A part of light is irradiated circumference through the tubular portion 51*a* of the casing 51.

On the other hand, heat produced from the LED element 13 is conducted to the first heat-receiving part 52*a* and the second heat-receiving part 52*b* of the heat-receiving member 52, conducted to the heat-transfer member 52*c*, radiated to the space from the heat-transfer member 15, and thereafter collected by the fins 51*c*. The collected heat is conducted from the fins 51*c* to the outer wall of the casing 51, and then radiated outside. Also, the heat produced from the LED element 13 is conducted to the first heat-receiving part 52*a* and the second heat-receiving part 52*b* of the heat-receiving member 52, directly radiated to the surrounding space from the heat-receiving member 52, and collected by the fins 51*c*. The collected heat is conducted from the fins 51*c* to the casing 51, and then radiated outside from the casing 51. Furthermore, according to the structure of this third embodiment, since the first heat-receiving part 52*a* and the second heat-receiving part 52*b* are in contact with the inner wall of the casing 51, direct heat conduction in high efficiency from the heat-receiving member 52 to the casing 51 is performed. The conducted heat is radiated from the casing 51 to the outside.

As will be noted, the heat-receiving member 52 has functions of receiving heat from the LED element 13 by heat conduction, and of lowering the temperature of the LED element 13. The heat-transfer member 52*c* thermally coupled with as a part of the heat-receiving member 52 and extended downward has functions of receiving heat from the heat-receiving member 52 by heat conduction, and of transferring the received heat to the space close to the fins 51*c* so as to radiate the heat. Particularly, in this third embodiment, since the first heat-receiving part 52*a* and the second heat-receiving part 52*b* of the heat-receiving member 52 and the heat-transfer member 52*c* are formed integrally in one piece, effective heat conduction from the first heat-receiving part 52*a* and the second heat-receiving part 52*b* to the heat-transfer member 52*c* can be expected causing good radiation effect of the LED lamp 1B. The fins 51*c* have functions of collecting the heat of the air in the space, and of conducting the collected heat to the casing 51 to radiate the heat outside. In this case, the heat from the LED element 13 is almost collected by the fins 51*c* to concentrate the heat to a part of the casing 11, that is out of the top end portion 51*b* through which the light is mainly irradiated, so as to increase a heat radiation amount through this part of the casing 51 to outside. Thus, even if the LED lamp 1B is turned on for a long time, a temperature of the whole outside surface of the casing 51 can be lowered to a degree that is not so hot when handling. As a result, a luminous efficiency of the LED element 13 can be increased, and a shortening of life of the LED element 13 due to the high heat can be prevented.

In the conventional LED lamp with no heat-receiving member, no heat-transfer member and no heat-collection fins, a temperature of a top end portion of the casing, through which the light is mainly irradiated, becomes extremely high and thus it is impossible to handle this portion of the casing. However, in this third embodiment, the plurality of fins 51*c* are arranged out of the top end portion 51*b* that is located in a main light emitting direction of the LED lamp 1B. Further, due to heat conduction of the heat-receiving member 52 and the heat-transfer member 52*c*, the heat from the LED element 13 is collected to the fins 51*c*, and also the heat in the space in the casing 51 is concentrated to the fins 51*c*. Therefore, the heat in the casing 51 is transferred with a high efficiency to a wide area of the casing 51, that is out of the top end portion 51*b* in a main light emitting direction of the LED lamp 1B so as to reduce an amount of heat conducted to the top end portion 51*b*. As a result, the top end portion 51*b* of the casing 51 does not become so hot as it is impossible to touch by hand, and the heat inside is radiated from the whole surface of the casing 51 to require no heat sink.

As described above, according to the third embodiment, although the LED lamp 1B is provided with the casing 51, made of a resin material having a poor thermal conductivity, for housing, in a semi-sealed state, the LED element 13 that is in other words a heater element with a high output, the heat from the LED element 13 is actively and aggressively conducted to the overall region of the casing 51 by cooperation of the first heat-receiving part 52*a* and the second heat-receiving part 52*b* of the heat-receiving member 52, the heat-transfer member 52*c* and the fins 51*c*, radiated to air in a wide space in the casing 51, and heat-exchanged between the whole outer surface of the casing 51 and outside air so as to perform heat radiation from the whole casing 51 for lowering the temperature of the casing 51. By performing such aggressive heat-conduction, it is possible to lower the temperature of the LED element 13 and to exist no air of high temperature caused by heat conduction from the LED element 13 in the casing 51. Thus, the casing 51 never becomes so hot as it is impossible to touch by hand and therefore safety of the LED lamp 1B can be expected. Also, because heat radiation from the whole of the casing 51 is performed, the temperature of overall the casing 51 can be lowered. Therefore, even when the LED lamp 1B is the semi-sealed type, the heat from the LED element 13 will not be accumulated and the temperature of the air in the casing 51 can be lowered to a value near the room temperature. As a result, it is possible to use a high output LED element, and also since no heat sink is necessary to equip, the appearance of the lighting installation becomes simple and downsizing of the lighting installation is possible.

Further, according to the third embodiment, since the LED element 13 is supported near the top end side of the casing 51, which is the side in a main light emitting direction of the LED lamp 1B, a large amount of light in the main irradiation direction can be obtained. Also, because the heat-transfer member 52*c* is not located in this direction, this member 52*c* will not block irradiation of light from the LED element 13. Since the LED element 13 is firmly supported by the heat-receiving member 52 in the casing 51, the LED element 13 can be held with stability and the main irradiation direction does not change, irrespective of the arrangement of the LED lamp 1B. Still further, because direct heat conduction from the heat-receiving member 52 to the casing 51 is performed through the contact surface, heat from the LED element 13 can be radiated more effectively.

According to the third embodiment, furthermore, because the casing 51 and the plurality of fins 51*c* are integrated, good heat-conduction and heat-collection effect can be expected. Also, the fins 51*c* can be freely designed in a shape whereby easy heat-transfer in the direction to the casing 51 can be expected. In addition, since the fins 51*c* can be easily molded and assembling of the LED lamp 1B is easy, it is possible to fabricate the LED lamp 1B in low-cost.

Fourth Embodiment

Figure 7A:
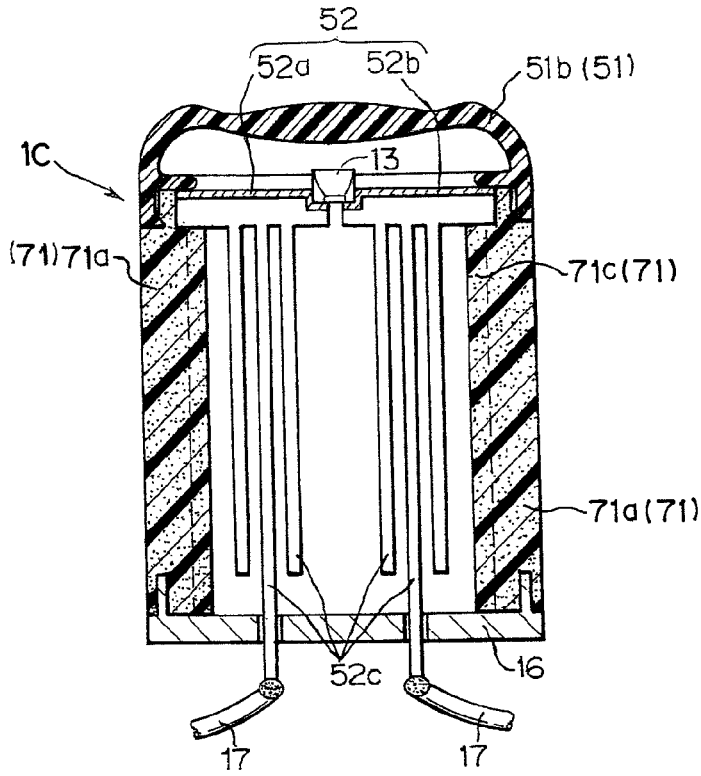
FIGS. 7A and 7B are an A-A line longitudinal section view of FIG. 1 and an exploded perspective view schematically illustrating a structure and a part of the structure of a LED lamp in a fourth embodiment according to the present invention.
Figure 7B:
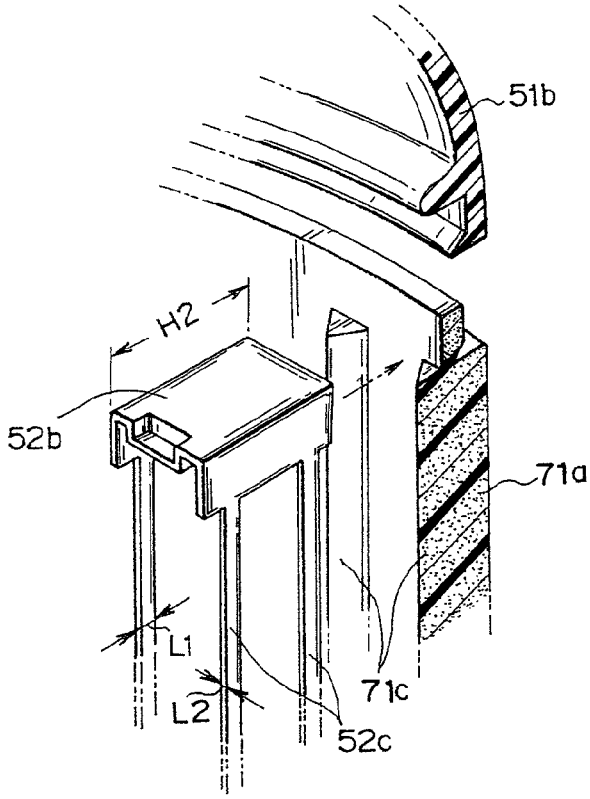

FIGS. 7A and 7B show an A-A line longitudinal section view of FIG. 1 and an exploded perspective view schematically illustrating a structure and a part of the structure of a LED lamp in a fourth embodiment according to the present invention, respectively. In FIGS. 7A and 7B, the same components as these in FIGS. 5A, 5B and 6 are indicated by using the same reference numerals.

In this fourth embodiment, a tubular member 71*a* of a casing 71 of a LED lamp 10 is formed by molding a mixture material of resin and black high thermal conductance carbon fiber fillers such as, for example, Raheama (registered trademark) of Teijin Ltd. but not general translucent resin material such as polycarbonate or acrylic as the tubular portion 51*a* in the third embodiment. A plurality of fins 71*c* having heat-collecting function are integrally formed with the inner wall of the tubular portion 71*a*.

Configuration of the LED lamp 1C of this fourth embodiment is quite the same as that of the LED lamp 1B of the third embodiment except as the material of the tubular portion 71*a* of the casing 71. Because the tubular portion 71*a* of the casing 71 is made of the resin material containing the high thermal conductance carbon fiber fillers, heat collection and heat-conduction effect of this tubular portion 71*a* is remarkably improved to further reduce the temperature of whole of the LED lamp 1C.

Other functions, advantages and modifications in this fourth embodiment are similar to these in the third embodiment.

Fifth Embodiment

Figure 8:
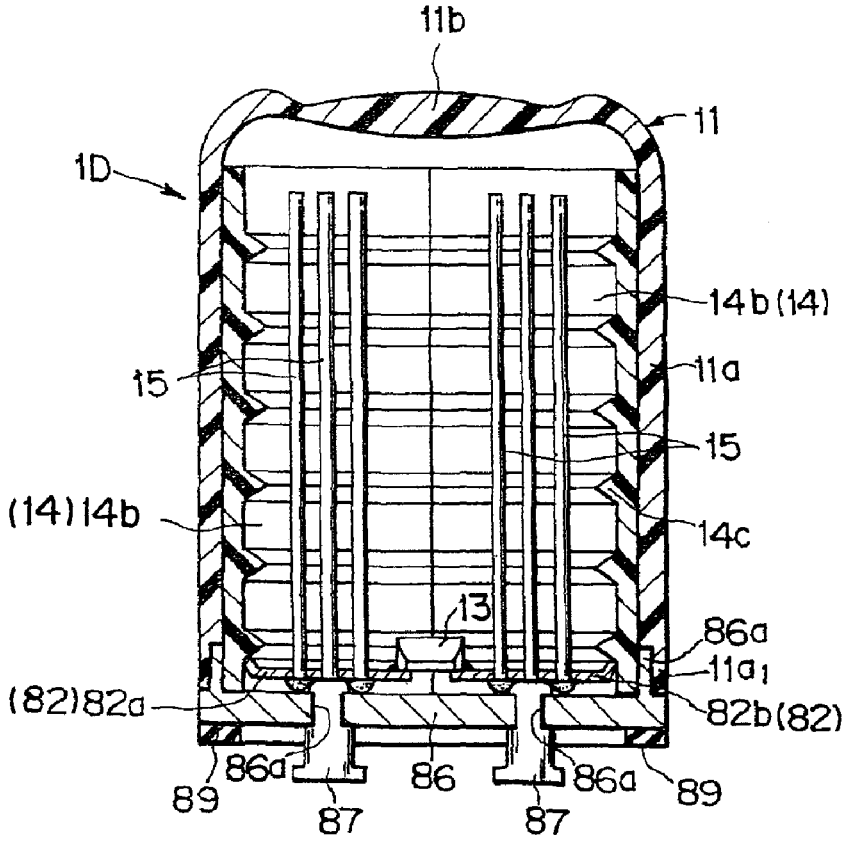
FIG. 8 is an A-A line longitudinal section view of FIG. 1 schematically illustrating a structure of a LED lamp in a fifth embodiment according to the present invention.

FIG. 8 is an A-A line longitudinal section view of FIG. 1 schematically illustrating a structure of a LED lamp in a fifth embodiment according to the present invention.

As shown in the figure, the LED lamp 1D has at least a casing 11, a LED element 13, a heat-receiving member 82 constituted of first and second heat-receiving parts 82*a* and 82*b* electrically and mechanically connected with electrode terminals of the LED element 13, respectively, a heat-collection fin member 14, and a heat-transfer member 15. These heat-receiving member 82, heat-collection fin member 14, heat-transfer member 15 and casing 11 constitute a heat radiation mechanism. The first heat-receiving part 82*a* and the second heat-receiving part 82*b* are arranged in a space near the top end side in the casing 11, and the heat-collection fin member 14 and the heat-transfer member 15 are arranged in a space near the base end side in the casing 11.

In this fifth embodiment, the whole of the casing 11 is made of a translucent resin material or a translucent glass material. A substrate 86 is fixed or adhered with the casing 11 by inserting this substrate 86 into the base end portion of the casing 11 so that the LED element 13, the heat-receiving member 82, the heat-collection fin member 14 and the heat-transfer member 15 are housed in the casing 11 under a semi-sealed state. Thus, the LED element 13, the heat-receiving member 82, the heat-collection fin member 14 and the heat-transfer member 15 are protected inside, and heat produced from the LED element 13 is radiated through the casing 11 to the outside. This casing 11 formed by molding, for example, a translucent resin material such as polycarbonate or acrylic material, or a translucent glass material, and the substrate 86 formed from the same material as the casing 11 are assembled to constitute a semi-sealed container.

The casing 11 in this fifth embodiment is molded in one piece with a tubular portion 11*a* and a top end portion 11*b*. However, in a modification, a tubular portion 11*a* and a top end portion 11*b* may be separately formed as discrete components and thereafter these discrete components may be fixed or adhered with each other to be integrated. Also, in another modification, the tubular portion 11*a* may be formed in, for example, a cylinder shape, a round pipe shape such as an oval pipe shape, a corner pipe shape, or other pipe shape with an optional cross-section.

The casing 11 has a translucency capable of transmitting light from at least the LED element 13 to illuminate the outside. In the configuration shown in FIG. 8, light from the LED element 13 is transmitted mainly through the tope end face portion 11*b* to illuminate the outside of the top end side and circumferentially through the tubular portion 11*a* of the casing 11. A lens may be formed at the top end portion 11*b*, namely as in this fifth embodiment, a central part of the top end portion 11*b* is formed in a convex shape and a neighboring circular part thereof is foamed in a concave circular shape. In a modification, a Fresnel lens may be formed at the top end portion 11*b*. In another modification, it is desired that the casing 11 is formed from a material of synthetic resin powder with scattered dispersing agents or antidazzle agents for reducing light intensity.

The substrate 86 is attached to an opening portion at the base end side of the casing 11 to close the opening of the casing 11 so as to keep the casing under the semi-sealed condition. A circular projection 86*a* having locking pawl (not shown) is formed on the top surface of the substrate 86. This circular projection 86*a* is inserted into a circular end edge 11$a_1$ formed on the tubular portion 11*a* of the casing 11 so that the substrate 86 and the casing 11 are adhered or fixed with each other. Also, through the substrate 86, formed are through-holes 86*b* to pass plug terminals 87. Furthermore, a circular seal packing 89 is formed to surround the bottom of the substrate 86 so that the LED lamp 1D is sealed when it is attached to the lighting installation.

Each of the first heat-receiving part 82*a* and the second heat-receiving part 82*b* that constitute the heat-receiving member 82 is formed by pressing a metal plate-like member with good conductivity and good heat transmission such as for example a copper plate, an aluminum plate, a nickel-plated copper plate or a nickel-plated aluminum plate to have a channel shape with a U-shaped section. Thanks for the channel shape, although the private space is small, the heat-receiving part can have a large surface area for providing good heat radiation effect. The first heat-receiving part 82*a* and the second heat-receiving part 82*b* are arranged in the casing 11 so that the bottom surface of the channel shape is located at the upper side, namely the both side ends of each heat-receiving part downwardly bend. One ends of the first heat-receiving part 82*a* and the second heat-receiving part 82*b* are connected with a pair of electrode terminals of the chip-type LED element 13, respectively, by means of welding or brazing such as soldering. In other words, the LED element 13 is sandwiched between the first heat-receiving part 82*a* and the second heat-receiving part 82*b* and thus supported from both sides. The other ends of the first heat-receiving part 82*a* and the second heat-receiving part 82*b* abut with an inner wall of the heat-collection fin member 14. That is, the first heat-receiving part 82*a* and the second heat-receiving part 82*b* of the heat-receiving member 82 radially extend from the connected portion with the LED element 13 in a cross section or a slice plane in the casing 11, and touch the inner wall of the heat-collection heat fin member 14. Thus, a length of each of the first heat-receiving part 82*a* and the second heat-receiving part 82*b* is determined so that sum of the length of the LED element 13 and the double of this length is substantially equal to an inside diameter of the heat-collection fin member 14.

Therefore, the first heat-receiving part 82*a* and the second heat-receiving part 82*b* serve as, other than the feeding lines, heat-transmission members for receiving heat from the LED element 13 and for transferring the received heat to the heat-collection fin member 14 and also to the heat-transfer member 15 so as to suppress increase in temperature of the LED element 13 and thus to maintain life of the LED element 13.

An area of each contact surface on the heat-collection fin member 14, that is, a area of the contact region between each of the other ends of the first heat-receiving part 82*a* and the second heat-receiving part 82*b* and the inner wall of the heat-collection fin member 14 depends on an area of the U-shaped section of the channel shape, which is determined from a height, a width and a thickness of each of the first heat-receiving part 82*a* and the second heat-receiving part 82*b* (see FIG. 2B). If this area of the section is large, the contact surface becomes large and thus high heat conduction effect from the heat-receiving member 82 to the heat-collection fin member 14 can be obtained.

The bottom surfaces of the channel shaped first heat-receiving part 82*a* and the channel shaped second heat-receiving part 82*b* have a plurality of holes for inserting as will be described later one ends of the heat-transfer member 15 there through.

One or more LED elements 13 are arranged in the casing 11. In this fifth embodiment, a single chip-type LED element 13 is mounted at substantially the axis center in the casing 11 to emit light there from toward the top end direction and the surrounding direction of the casing 11. As mentioned before, one electrode terminal of the LED element 13 is connected and supported by one end of the first heat-receiving part 82*a*, and the other electrode terminal of the LED element 13 is connected and supported by one end of the second heat-receiving part 82*b*. Although a chip-type element is adopted for the LED element 13 in this fifth embodiment, a cannon ball type or a segment type element can be adopted for the LED element 13 in modifications.

A direct current is supplied to the LED element 13 through the first heat-receiving part 82*a* and the second heat-receiving part 82*b* electrically connected to the electrode terminals of this LED element 13. The LED element 13 thus emits light and this emitted light is radiated outwardly through the top end portion 11*b* of the casing 11 and circumferentially through the tubular portion 11*a* of the casing 11. Because the heat produced from the LED element 13 is conducted through the electrode terminals to the first heat-receiving part 82*a* and the second heat-receiving part 82*b*, and outwardly radiated as will be described later, the LED element 13 is suppressed to maintain its temperature and therefore the luminous efficiency of the LED element 13 is kept at a high level. It should be noted that the light from the LED element 13 is irradiated outside through the whole surface of the casing 11, and that heat from the LED element 13 is also radiated outside through the whole surface of the casing 11.

The heat-collection fin member 14 is formed of a cylinder with an outer wall that firmly attached to an inner wall of the casing 11 so that heat transmission from the fin member 14 to the casing 11 is possible, in other words, so that the fin member 14 is thermally coupled to the casing 11. Particularly, in this fifth embodiment, the fin member 14 is formed by assembling and fixing a first segment 14*a* and a second segment 14*b* each having a half cylinder shape, which would be obtained by dividing a cylinder shape into two segments by a plane passing through the center axis of the cylinder. In modifications, the segment may have a shape obtained by dividing a cylinder shape into three or more by a plane passing through the center axis of the cylinder. The heat-collection fin member 14 is made of, for example, a translucent resin material such as polycarbonate or acrylic material, that is, the same material as the casing 11. A plurality of fins 14*c* having heat-collecting function are integrally formed with the inner wall of the heat-collection fin member 14. Because the fin member 14 is preliminarily divided in the first segment 14*a* and the second segment 14*b*, it is easy to mold these first and second segments 14*a* and 14*b* and the plurality of fins 14*c*.

The plurality of fins 14*c* formed on the inner wall of the heat-collection fin member 14 are arranged with an interval in a longitudinal direction of the fin member 14, and each fin 14*c* has a rib shape extending along the circumferential direction of the fin member 14. In modifications of this fifth embodiment, each fin 14*c* may be a fin with a column shape (rib shape extending the longitudinal direction), a spiral shape, a mesh shape, a porous plate shape or other not flat shape. The plurality of fins 14*c* are formed at an interval, which is determined so that air can freely flow to easily occur convection of air. Thus, adequate heat transfer from air to the fins 14*c* can be performed. In modifications, the heat-collection fin member 14 may be molded in one piece with the casing 11.

The heat-transfer member 15 is configured from a plurality of hollow or solid bars made of a metal material with good heat-transfer characteristics, such as copper, aluminum or else. It is desired that the heat-transfer member 15 is made of the same material as that of the heat-receiving member 82. One ends of these bars of the heat-transfer member 15 are engaged in holes formed through the first heat-receiving part 82*a* and the second heat-receiving part 82*b*, and then electrically and mechanically connected or fixed with the first heat-receiving part 82*a* and the second heat-receiving part 82*b* by soldering. The bars are linearly extended upward and the other ends thereof are located, as free ends, at a height corresponding to the upper end of the heat-collection fin member 14. It is desired from a point of view of heat-transmission that the heat-transfer member 15 is in contact with the heat-collection fin member 14. However, in practice, it is enough as shown in FIG. 8 that the heat-transfer member 15 is extended along the fin member 14 apart from the LED element 13. It is important that the bars connected with the first heat-receiving part 82*a* and the bars connected with the second heat-receiving part 82*b* are never electrically in contact with each other to avoid occurrence of short-circuit.

In this fifth embodiment, each bar of the heat-transfer member 15 is configured from a copper pipe linearly extending, and has a surface area that depends upon a length and an outer diameter of the copper pipe. If the surface area increases, due to the hollow pipe, the total surface area further increases causing the heat conduction effect to more increase. By the way, in this fifth embodiment, a copper pipe of R=2 mm ϕ is used. In modifications, a solid line of a copper wire of R=1 mm ϕ may be used as for the bar. However, in the latter case, the surface area will become small.

In modifications of this fifth embodiment, each bar of the heat-transfer member 15 is formed from a solid line, an elongated solid bar, an elongated plate member, an elongated mesh member, an elongated porous member or others. This heat-transfer member 15, the first heat-receiving part 82*a* and the second heat-receiving part 82*b* may be formed by molding in one piece.

In this fifth embodiment, the first heat-receiving part 82*a* and the second heat-receiving part 82*b* are sandwiched by the heat-collection fin member 14 to locate at the lowest position in the casing 11. The plug terminals 87 are electrically connected to the first heat-receiving part 82*a* and the second heat-receiving part 82*b*, respectively. Thus, the first heat-receiving part 82*a* and the second heat-receiving part 82*b* are fixed to the substrate 86 by also the plug terminals 87. In this embodiment, the plug terminals 87 can fit a socket with the similar structure as a glow lamp socket to mount the LED lamp 1D in and to electrically connect to the lighting installation.

Drive current will be fed through the plug terminals 87 from the outside. This current is supplied to the LED element 13 through the plug terminals 87, the heat-transfer member 15 and the first heat-receiving part 82*a* or the second heat-receiving part 82*b*.

When assembling such LED lamp 1D, first, an assembly of the LED element 13, the heat-receiving member 82 and the heat-transfer member 15 is mounted on the substrate 86 and the plug terminals 87. Then, the assembly with the substrate 86 is sandwiched between the first segment 14*a* and the second segment 14*b* of the heat-collection fin member 14, and thereafter the casing 11 is attached to cover the heat-collection fin member 14 so as to integrate the heat-collection fin member 14 and the casing 11. As a result, the LED lamp 1D can be easily assembled.

According to thus assembled LED lamp 1D, by feeding power to the LED element 13 via the plug terminals 87, the heat-transfer member 15 and the first heat-receiving part 82*a* and the second heat-receiving part 82*b*, the LED element 13 emits light, which is irradiated to top end outward direction through the top end portion 11*b* of the casing 11 and to circumferential direction through the heat-collection fin member 14 and the tubular portion 11*a* of the casing 11. Since the LED element 13 is located at the lowest position of the casing 11, the light from the LED element 13 is irradiated outside through the whole surface of the casing 11, and also heat from the LED element 13 is transferred to the whole of the casing 11. Thus, large thermal radiation can be obtained from the whole surface of the casing 11. Therefore, if the LED lamp 1D has a plurality of LED elements to provide a large amount of light and to produce a large amount of heat, effective heat radiation can be expected. Also, an intensity of light irradiated outward can be adjusted depending upon a distance between the LED element 13 and a lens of the top end portion 11*b* of the casing, that is, by determining a position of the LED element 13 and a length of the tubular portion 11*a*.

On the other hand, heat produced from the LED element 13 is conducted to the first heat-receiving part 82*a* and the second heat-receiving part 82*b* of the heat-receiving member 82, conducted from the heat-receiving member 82 to the heat-transfer member 15, radiated to the space from the heat-transfer member 15, and thereafter collected by the heat-collection fin member 14. The collected heat is conducted from the fin member 14 to the inner wall of the casing 11, and then radiated outside from the outer wall of the casing 11.

Also, the heat produced from the LED element 13 is conducted to the first heat-receiving part 82*a* and the second heat-receiving part 82*b* of the heat-receiving member 82, directly radiated to the surrounding space from the heat-receiving member 82, and collected by the heat-collection fin member 14. The collected heat is conducted from the fin member 14 to the casing 11, and then radiated outside from the casing 11. Furthermore, according to the structure of this fifth embodiment, since the first heat-receiving part 82*a* and the second heat-receiving part 82*b* are in contact with the inner wall of the heat-collection fin member 14, direct heat conduction in high efficiency from the heat-receiving member 82 to the fin member 14 is performed. The conducted heat is conducted to the casing 11 and then radiated to the outside.

As will be noted, the heat-receiving member 82 has functions of receiving heat from the LED element 13 by heat conduction, and of lowering the temperature of the LED element 13. The heat-transfer member 15 thermally coupled with the heat-receiving member 82 and extended upward has functions of receiving heat from the heat-receiving member 82 by heat conduction, and of transferring the received heat to the space close to the heat-collection fin member 14 so as to radiate the heat. The heat-collection fin member 14 has functions of collecting the heat of the air in the space, and of conducting the collected heat to the casing 11 to radiate the heat outside. In this case, the heat from the LED element 13 is radiated from the whole surface of the casing 11 outside. Thus, even if the LED lamp 1D is turned on for a long time, a temperature of the whole outside surface of the casing 11 can be lowered to a degree that is not so hot when handling. As a result, a luminous efficiency of the LED element 13 can be increased, and a shortening of life of the LED element 13 due to the high heat can be prevented.

In the conventional LED lamp with no heat-receiving member, no heat-transfer member and no heat-collection fin member, a temperature of a top end portion of the casing, through which the light is mainly irradiated, becomes extremely high and thus it is impossible to handle this portion of the casing. However, in this fifth embodiment, the heat-collection fin member 14 is provided and due to heat conduction of the heat-receiving member 82 and the heat-transfer member 15, the heat from the LED element 13 is dispersed to the whole of the casing 11, an amount of heat transferred to the top end portion 11*b* of the casing 11 is reduced. As a result, the top end portion 11*b* of the casing 11 does not become so hot as it is impossible to touch by hand, and the heat inside is radiated from the whole surface of the casing 11 to require no heat sink.

As described above, according to the fifth embodiment, although the LED lamp 1D is provided with the casing 11, made of a resin material having a poor thermal conductivity, for housing, in a semi-sealed state, the LED element 13 that is in other words a heater element with a high output, the heat from the LED element 13 is actively and aggressively conducted to the overall region of the casing 11 by cooperation of the first heat-receiving part 82*a* and the second heat-receiving part 82*b* of the heat-receiving member 82, the heat-transfer member 15 and the heat-collection fin member 14, radiated to air in a wide space in the casing 11, and heat-exchanged between the whole outer surface of the casing 11 and outside air so as to perform heat radiation from the whole casing 11 for lowering the temperature of the casing 11. By performing such aggressive heat-conduction, it is possible to lower the temperature of the LED element 13 and to exist no air of high temperature caused by heat conduction from the LED element 13 in the casing 11. Thus, the casing 11 never becomes so hot as it is impossible to touch by hand and therefore safety of the LED lamp 1D can be expected. Also, because heat radiation from the whole of the casing 11 is performed, the temperature of overall the casing 11 can be lowered. Therefore, even when the LED lamp 1D is the semi-sealed type, the heat from the LED element 13 will not be accumulated and the temperature of the air in the casing 11 can be lowered to a value near the room temperature. As a result, it is possible to use a high output LED element, and also since no heat sink is necessary to equip, the appearance of the lighting installation becomes simple and downsizing of the lighting installation is possible.

Further, according to the fifth embodiment, since the LED element 13 and the heat-transfer member 15 are firmly supported by the heat-receiving member 82 and the plug terminals 87 and attached to the substrate 86 and the casing 11, the LED element 13 can be held with stability and the main irradiation direction does not change, irrespective of the arrangement of the LED lamp 1D. Still further, because direct heat conduction from the heat-receiving member 82 to the heat-collection fin member 14 and the casing 11 is performed through the contact surface 14*d*, heat from the LED element 13 can be radiated more effectively.

According to the fifth embodiment, furthermore, because the first segment 14*a* and the second segment 14*b* and the plurality of fins 14*c* are integrated, good heat-conduction and heat-collection effect can be expected. Also, the heat-collection fin member 14 can be freely designed in a shape whereby easy heat-transfer in the direction to the casing 11 can be expected. In addition, since the heat-collection fin member 14 can be easily molded and assembling of the LED lamp 1D is easy, it is possible to fabricate the LED lamp 1D in low-cost.

Sixth Embodiment

Figure 9:
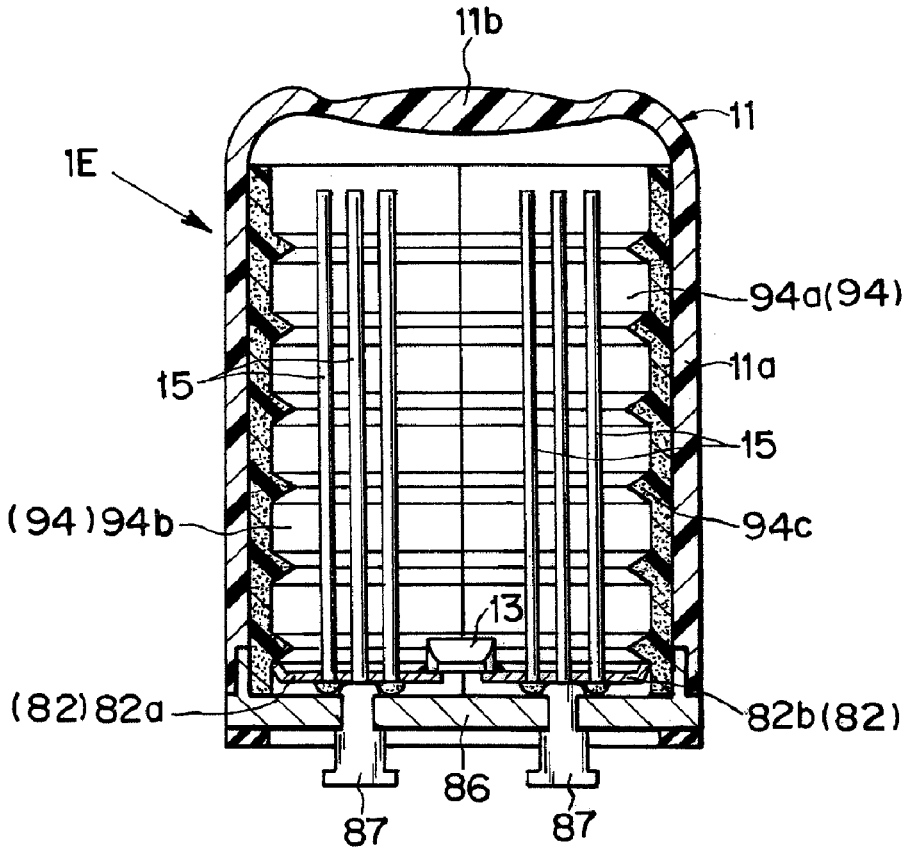
FIG. 9 is an A-A line longitudinal section view of FIG. 1 schematically illustrating a structure of a LED lamp in a sixth embodiment according to the present invention.

FIG. 9 shows an A-A line longitudinal section view of FIG. 1 schematically illustrating a structure and a part of the structure of a LED lamp in a sixth embodiment according to the present invention. In FIG. 9, the same components as these in FIG. 8 are indicated by using the same reference numerals.

In this sixth embodiment, a heat-collection fin member 94 of a LED lamp 1E is formed by molding a mixture material of resin and black high thermal conductance carbon fiber fillers such as, for example, Raheama (registered trademark) of Teijin Ltd. but not general translucent resin material such as polycarbonate or acrylic as the heat-collection fin member 14 in the first and fifth embodiments. The heat-collection fin member 94 is formed by assembling and fixing a first segment 94*a* and a second segment 94*b* each having a half cylinder shape, which would be obtained by dividing a cylinder shape into two segments by a plane passing through the center axis of the cylinder. A plurality of fins 94*c* having heat-collecting function are integrally formed with the inner wall of the heat-collection fin member 94.

Configuration of the LED lamp 1E of this sixth embodiment is quite the same as that of the LED lamp 1D of the fifth embodiment except as the material of the heat-collection fin member 94. Because the heat-collection fin member 94 is made of the resin material containing the high thermal conductance carbon fiber fillers, heat collection and heat-conduction effect of this fin member 94 is remarkably improved to further reduce the temperature of whole of the LED lamp 1E.

Other functions, advantages and modifications in this sixth embodiment are similar to these in the fifth embodiment.

Seventh Embodiment

Figure 10:
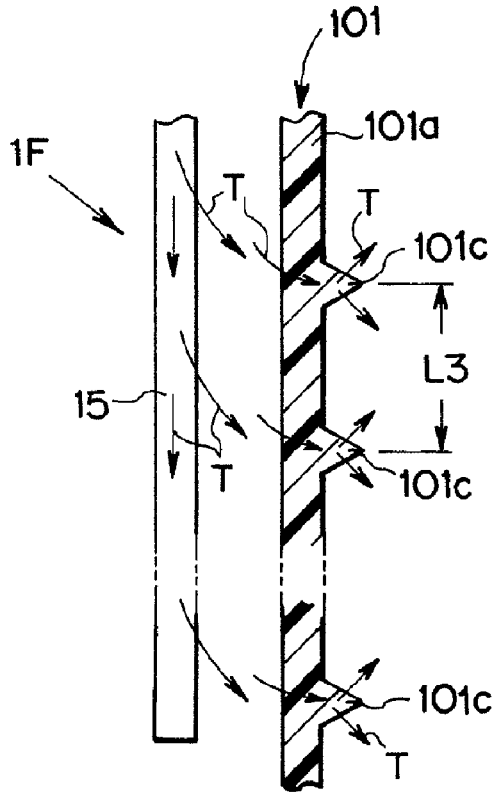
FIG. 10 is a section view schematically illustrating a part of a structure of a LED lamp in a seventh embodiment according to the present invention.

FIG. 10 shows a section view schematically illustrating a part of a structure of a LED lamp in a seventh embodiment according to the present invention.

Although it is not shown in this figure, a LED lamp 1F has at least a casing 101, a LED element similar to that in the first embodiment, a first heat-receiving part and a second heat-receiving part similar to these in the first embodiment and electrically and mechanically connected with electrode terminals of the LED element, and a heat-transfer member 15 similar to that in the first embodiment. The heat-receiving member, the heat-transfer member 15 and a tubular portion 101*a* of the casing 11, which has a function of the heat-collection fin member constitute a heat radiation mechanism.

Since configurations of this seventh embodiment are partly the same as that of the first embodiment shown in FIGS. 2 and 3 and that of the third embodiment shown in FIGS. 5 and 6 except for the configurations of the casing 101, hereinafter only configurations, functions and advantages of the casing 101 will be described.

In this the seventh embodiment, a plurality of heat-radiation fins 101*c* having heat-collection function are formed integrally to an external wall of the tubular portion 101*a* of the casing 101. The plurality of heat radiation fins 101*c* are arranged with an interval L3 in a longitudinal direction of the casing 101, and each fin 101*c* has a rib shape extending along the circumferential direction of the casing 101.

In modifications of this seventh embodiment, each heat-radiation fin 101*c* may be a fin with a column shape (rib shape extending the longitudinal direction), a spiral shape, a mesh shape, a porous plate shape or other not flat shape. The plurality of fins 101*c* are formed at an interval, which is determined so that air can freely flow to easily occur convection of air. Thus, adequate heat transfer from the fins 101*c* to outer air can be performed.

According to the above-mentioned configurations, heat T conducted to the heat-transfer member 15 is radiated to air in a wide space in the casing 101. The heat T of the air in the casing 101 is transferred to the wide region of the casing 101. The heat T transferred to the casing 101 is conducted to the radiation fins 101*c* located out of the top end side of the casing 101, which is out of the main irradiating direction of the LED lamp 1F. The radiation fins 101*c* has a large area for contacting outside air and thus can effectively radiate the heat T in response to a thermal gradient occurred between the fins and the outside air. As a result, the amount of heat radiated from a part of the casing 101, that is out of the top end portion through which the light is mainly irradiated, increases so as to lower the temperature of this part of the casing 101. Since the heat T from the LED element is effectively radiated outside even if the casing is in a semi-sealed state, a luminous efficiency of the LED element can be increased, and a shortening of life of the LED element due to the high heat can be prevented.

As described above, according to this seventh embodiment, the heat from the LED element is actively conducted to the overall region of the casing 101 by the heat-transfer member 15, and then the conducted heat is radiated from the radiation fins 101*c* formed on the outer wall of the casing 101. Namely, the heat is effectively radiated outside by cooperation of the heat-transfer member 15 and the radiation fins 101*c*. By performing such active heat-radiation, it is possible to lower the temperature of the LED element and to exist no air of high temperature caused by heat conduction from the LED element in the casing 101. Thus, the casing 101 never becomes so hot as it is impossible to touch by hand and therefore safety of the LED lamp 1F can be expected. Also, because heat exchange between the outside air and the wide area of the radiation fins 101*c* formed on the outer surface of the casing 101 is performed and further the radiation is performed over the whole of the casing 101, the temperature of the casing 11 can be lowered. Therefore, even when the LED lamp 1F is the semi-sealed type using the casing 101 made of the resin material with a poor heat-conduction, the heat from the LED element will not be accumulated and the temperature of the air in the casing 101 can be lowered to a value near the room temperature. As a result, it is possible to use a high output LED element, and also since no heat sink is necessary to equip, the appearance of the lighting installation becomes simple and downsizing of the lighting installation is possible.

In modifications of this seventh embodiment, a heat-collection fin member may be additionally formed inside of the casing 101 as well as the first to sixth embodiments. In this case, heat-radiation functions can be more increased. In another modification, the radiation fins 101*c* may be separately formed from the casing 101 and then integrally attached to the outer surface of the casing 101 to cover the tubular casing and to thermally couple with the tubular casing.

Furthermore, in modifications of the first to seventh embodiments according to the present invention, a metal film may be covered over the casing to easily radiate heat. In still further modification, the LED lamp may have a power supply structure with a socket structure attached to the side surface of the casing. In this case, one of another side surface, a bottom surface and a top surface may be determined as a main irradiation surface, and a heat-collection fin member may be formed on the remaining surface.

Many widely different embodiments of the present invention may be constructed without departing from the spirit and scope of the present invention. It should be understood that the present invention is not limited to the specific embodiments described in the specification, except as defined in the appended claims.

The invention claimed is:

1. A light-emitting diode lamp comprising:

at least one light-emitting diode element having electrode terminals;

a conductive heat-receiving member, electrically and mechanically connected with said electrode terminals of said at least one light-emitting diode element, for receiving heat emitted from said at least one light-emitting diode element via said electrode terminals;

a casing for housing, at substantially sealed state, said at least one light-emitting diode element and said heat-receiving member;

a plurality of fins thermally coupled with said casing and arranged at a position out of a main irradiation direction of light from said at least one light-emitting diode element; and a conductive heat-transfer member electrically and mechanically connected with said heat-receiving member, said heat-transfer member extending to a position at which said plurality of fins exist, said plurality of fins being formed on an inner wall of a heat-collection fin member with an outer wall kept in contact with an inner wall of said casing, said heat-collection fin member being made of a translucent resin material.

2. The light-emitting diode lamp as claimed in claim 1, wherein one end of said heat-receiving member is connected to an electrode terminal of said at least one light-emitting diode element, and the other end of said heat-receiving member abuts to an inner wall of said casing.

3. The light-emitting diode lamp as claimed in claim 1, wherein said heat-receiving member and said heat-transfer member are formed by fixing separately fabricated members to each other.

4. The light-emitting diode lamp as claimed in claim 1, wherein said heat-receiving member and said heat-transfer member are formed from members made in one piece.

5. The light-emitting diode lamp as claimed in claim 1, wherein said heat-collection fin member comprises a plurality of segments separately formed with each other to have a shape obtained by dividing said casing by a plane passing through the center axis of said casing.

6. A light-emitting diode lamp comprising:

at least one light-emitting diode element having electrode terminals;

a conductive heat-receiving member, electrically and mechanically connected with said electrode terminals of said at least one light-emitting diode element, for receiving heat emitted from said at least one light-emitting diode element via said electrode terminals;

a casing for housing, at substantially sealed state, said at least one light-emitting diode element and said heat-receiving member;

a plurality of fins thermally coupled with said casing and arranged at a position out of a main irradiation direction of light from at least one light-emitting diode element; and a conductive heat-transfer member electrically and mechanically connected with said heat-receiving member, said heat-transfer member extending to a position at which said plurality of fins exist, said plurality of fins being formed on an inner wall of a heat-collection fin member with an outer wall kept in contact with an inner wall of said casing, said heat-collection fin member being made of a resin material containing high thermal conductance carbon fiber fillers.

7. The light-emitting diode lamp as claimed in claim 1, wherein said plurality of fins comprise heat-collection fins integrally formed with an inner wall of said casing.

8. The light-emitting diode lamp as claimed in claim 1, wherein said plurality of fins comprise heat-radiation fins integrally formed with an outer wall of said casing.

9. The light-emitting diode lamp as claimed in claim 1, wherein said casing comprises a top end portion formed in a main irradiation direction of said at least one light-emitting diode element, and a tubular portion is continuously formed with said top end portion at a position out of the main irradiation direction.

10. The light-emitting diode lamp as claimed in claim 9, wherein said top end portion and said tubular portion of said casing are made of a translucent resin material.

11. The light-emitting diode lamp as claimed in claim 9, wherein said top end portion of said casing is made of a translucent resin material, and said tubular portion of said casing is made of a resin material containing high thermal conductance carbon fiber fillers.

12. The light-emitting diode lamp as claimed in claim 1, wherein said heat-transfer member comprises a plurality of bars or strips extending from said heat-receiving member.

13. The light-emitting diode lamp as claimed in claim 1, wherein said heat-transfer member constitutes a part of a feeding line for supplying power there through to said at least one light-emitting diode element.

* * * * *